US008992248B2

(12) United States Patent
O'Malley et al.

(10) Patent No.: US 8,992,248 B2
(45) Date of Patent: Mar. 31, 2015

(54) MODULAR JACK WITH ENHANCED PORT ISOLATION

(75) Inventors: Brian P. O'Malley, Naperville, IL (US); Michael R. Kamarauskas, Bartlett, IL (US); Timothy R. McClelland, Bolingbrook, IL (US); Emanuel G. Banakis, Naperville, IL (US); Johnny Chen, Danville, CA (US); Kent E. Regnier, Lombard, IL (US)

(73) Assignee: Molex Incorporated, Lisle, IL (US)

( * ) Notice: Subject to any disclaimer, the term of this patent is extended or adjusted under 35 U.S.C. 154(b) by 191 days.

(21) Appl. No.: 13/508,467

(22) PCT Filed: Nov. 4, 2010

(86) PCT No.: PCT/US2010/055446

§ 371 (c)(1),
(2), (4) Date: Jan. 8, 2013

(87) PCT Pub. No.: WO2011/056973

PCT Pub. Date: May 12, 2011

(65) Prior Publication Data

US 2013/0102203 A1 Apr. 25, 2013

Related U.S. Application Data

(60) Provisional application No. 61/258,983, filed on Nov. 6, 2009, provisional application No. 61/267,128, filed on Dec. 7, 2009, provisional application No. 61/267,207, filed on Dec. 7, 2009.

(51) Int. Cl.

| | |
|---|---|
| ***H01R 13/66*** | (2006.01) |
| ***H01R 13/6469*** | (2011.01) |
| *H01R 107/00* | (2006.01) |

(52) U.S. Cl.

CPC ..... *H01R 13/66* (2013.01); *H01R 13/6469* (2013.01); *H01R 13/6633* (2013.01); *H01R 2107/00* (2013.01)

USPC ..... 439/541.5; 439/607.28; 439/607.46; 439/607.1; 439/676

(58) Field of Classification Search

USPC ..... 439/607.23, 607.24, 607.25, 540.1, 439/541.5, 701, 676

See application file for complete search history.

(56) References Cited

U.S. PATENT DOCUMENTS

| | | | | |
|---|---|---|---|---|
| 6,159,039 | A | 12/2000 | Wu | |
| 6,162,089 | A | 12/2000 | Costello et al. | |
| 6,206,725 | B1 | 3/2001 | Wu | |
| 6,302,741 | B1 | 10/2001 | Fasold et al. | |
| 6,511,348 | B1 * | 1/2003 | Wojtacki et al. | 439/620.18 |
| 6,537,110 | B1 | 3/2003 | Korsunsky et al. | |

(Continued)

OTHER PUBLICATIONS

International Search Report for PCT/US2010/055446.

*Primary Examiner* — Briggitte R Hammond
(74) *Attorney, Agent, or Firm* — Stephen L. Sheldon

(57) ABSTRACT

An electrical connector includes a dielectric housing with a plurality of filtering modules therein. Each filtering module has a housing and a magnetics assembly including transformer cores with wires wrapped therearound. An array of pins extend from the module housing for connection to the wires. A plurality of tails extend from the module housing for interconnection to a circuit board upon which the connector may be mounted. An interconnection is provided between the pins and tails that may include filtering or other signal modifying circuitry.

19 Claims, 20 Drawing Sheets

(56) References Cited

U.S. PATENT DOCUMENTS

| | | | | |
|---|---|---|---|---|
| 6,572,411 | B1 | 6/2003 | Aeschbacher et al. | |
| 6,612,871 | B1 | 9/2003 | Givens | |
| 6,641,440 | B1 | 11/2003 | Hyland et al. | |
| 6,655,988 | B1 | 12/2003 | Simmons et al. | |
| 6,659,807 | B1 | 12/2003 | Zheng et al. | |
| 6,695,646 | B1 | 2/2004 | Grabbe | |
| 6,699,071 | B1 * | 3/2004 | Hyland | 439/607.19 |
| 6,736,673 | B1 * | 5/2004 | Simmons et al. | 439/541.5 |
| 6,743,047 | B2 | 6/2004 | Korsunsky et al. | |
| 6,817,890 | B1 | 11/2004 | Schindler | |
| 6,962,511 | B2 * | 11/2005 | Gutierrez et al. | 439/676 |
| 7,033,210 | B1 * | 4/2006 | Laurer et al. | 439/541.5 |
| 7,241,181 | B2 * | 7/2007 | Machado et al. | 439/676 |
| 7,309,260 | B2 | 12/2007 | Brower et al. | |
| 7,674,136 | B2 * | 3/2010 | Steinke et al. | 439/676 |
| 7,712,941 | B2 * | 5/2010 | Tai et al. | 362/581 |
| 7,771,230 | B2 * | 8/2010 | Hammond et al. | 439/541.5 |
| 7,775,828 | B2 * | 8/2010 | Zhang | 439/540.1 |
| 7,775,829 | B2 * | 8/2010 | Zhang | 439/541.5 |
| 8,206,019 | B2 * | 6/2012 | Chen et al. | 362/581 |
| 8,215,982 | B2 * | 7/2012 | Bu et al. | 439/490 |
| 8,284,007 | B1 | 10/2012 | Langner et al. | |
| 8,333,599 | B2 | 12/2012 | Xu et al. | |
| 2004/0002258 | A1 * | 1/2004 | Zheng et al. | 439/541.5 |
| 2005/0255746 | A1 * | 11/2005 | Hyland | 439/541.5 |
| 2006/0030221 | A1 | 2/2006 | Hyland et al. | |
| 2009/0098766 | A1 * | 4/2009 | Steinke et al. | 439/541.5 |
| 2009/0253293 | A1 * | 10/2009 | Zhang | 439/541.5 |
| 2010/0015852 | A1 * | 1/2010 | Xu et al. | 439/620.09 |
| 2010/0124842 | A1 * | 5/2010 | Bu et al. | 439/541.5 |
| 2012/0315794 | A1 * | 12/2012 | Chen et al. | 439/620.07 |

* cited by examiner

MODULAR JACK WITH ENHANCED PORT ISOLATION

CROSS-REFERENCE TO RELATED APPLICATIONS

This patent application is a national phase of PCT Application No. PCT/US2010/055446, filed Nov. 4, 2010, which in turn claims the benefit of U.S. Provisional Patent Application No. 61/258,983, filed Nov. 6, 2009, Application No. 61/267,128, filed Dec. 7, 2009, and Application No. 61/267,207, filed Dec. 7, 2009, all of which are incorporated herein by reference in their entirety.

BACKGROUND

The present disclosure relates generally to modular telecommunications jacks and, more particularly, to a high data rate capable modular jack.

Modular jack ("modjack") receptacle connectors mounted to printed circuit boards ("PCBs") are well known in the telecommunications industry. These connectors are often used for electrical connection between two electrical communication devices. With the ever-increasing operating frequencies and data rates of data and communication systems and the increased levels of encoding used to transmit information, the electrical characteristics of such connectors are of increasing importance. In particular, it is desirable that these modjack connectors do not negatively affect the signals transmitted and where possible, noise is removed from the system.

When used as Ethernet connectors, modjacks generally receive an input signal from one electrical device and then communicate a corresponding output signal to a second device coupled thereto. Magnetic circuitry can be used to provide conditioning and isolation of the signals as they pass from the first device to the second and typically such circuitry uses components such as a transformer and a choke. The transformer often is toroidal in shape and includes a primary and secondary wire coupled together and wrapped around a toroid so as to provide magnetic coupling between the primary and secondary wires while ensuring electrical isolation. Chokes are also commonly used to filter out unwanted noise, such as common-mode noise, and can be toroidal ferrite designs used in differential signaling applications. Modjacks having such magnetic circuitry are typically referred to in the trade as magnetic jacks.

As system data rates have increased, systems have become increasingly sensitive to cross-talk between ports. Magnetic subassemblies that operate within a predetermined range of electrical tolerances at one data rate (such as 1 Gbps) may be out of tolerance or inoperable at higher date rates (such as 10 Gbps). Accordingly, improving the isolation between the ports of the magnetic jacks has become desirable in order to permit a corresponding increase in the data rate of signals that pass through the system. Cross-talk and electro-magnetic radiation and interference between ports may impact the performance of the magnetic jack (and thus the entire system) as system speeds and data rates increase. Improvements in shielding and isolation between ports as well as simplifying the manufacturing process of a magnetic jack is thus desirable.

SUMMARY

An electrical connector includes a housing having a mating face and a pair of first and second aligned openings. Each opening is configured to receive a mateable component therein. A plurality of electrically conductive contacts are provided with a portion of each contact being positioned in one of the openings for engaging contacts of a mateable component upon inserting a mateable component into one of the openings. A circuit member has a generally planar conductive reference plane extending between forward and rearward ends thereof. A forward portion of the reference plane is located between at least half of the pair of first and second aligned openings.

BRIEF DESCRIPTION OF THE DRAWINGS

Various other objects, features and attendant advantages will become more fully appreciated as the same becomes better understood when considered in conjunction with the accompanying drawings in which like reference characters designate the same or similar parts throughout the several views, and in which.

DETAILED DESCRIPTION OF THE ILLUSTRATED EMBODIMENT

The following description is intended to convey the operation of exemplary embodiments to those skilled in the art. It will be appreciated that this description is intended to aid the reader, not to limit the invention. As such, references to a feature or aspect are intended to describe a feature or aspect of an embodiment, not to imply that every embodiment must have the described characteristic. Furthermore, it should be noted that the depicted detailed description illustrates a number of features. While certain features have been combined together to illustrate potential system designs, those features may also be used in other combinations not expressly disclosed. Thus, the depicted combinations are not intended to be limiting unless otherwise noted.

Figure 1:
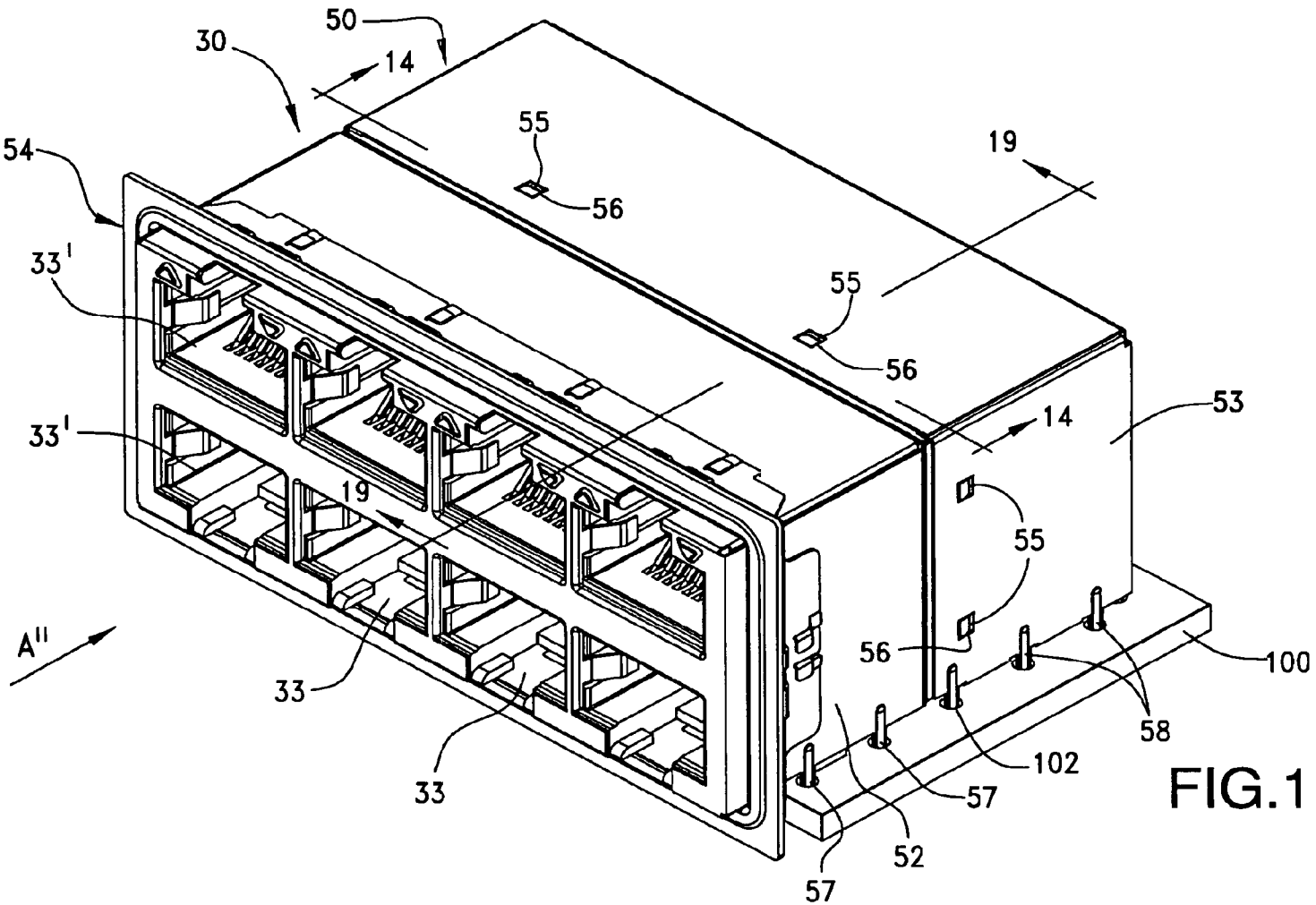
FIG. 1 is a front perspective view of a multiport magnetic jack assembly in accordance with a first embodiment.

FIG. 1 illustrates the front side of a multiple input, magnetic, stacked jack 30 having a housing 32 made of an insulating material such as a synthetic resin (for example, PBT) and includes front side openings or ports 33 arranged in vertically aligned pairs 33' with each port configured to receive an Ethernet or RJ-45 type jack (not shown) inserted therein in mating direction "A." The magnetic jack 30 is configured to be mounted on circuit board 100. A metal or other conductive shield assembly 50 surrounds the magnetic jack housing 32 for RF and EMI shielding purposes as well as for providing a ground reference.

It should be noted that in this description, representations of directions such as up, down, left, right, front, rear, and the like, used for explaining the structure and movement of each part of the disclosed embodiment are not intended to be absolute, but rather are relative. These representations are appropriate when each part of the disclosed embodiment is in the position shown in the figures. If the position or frame of reference of the disclosed embodiment changes, however, these representations are to be changed according to the change in the position or frame of reference of the disclosed embodiment.

Shield assembly or member 50 fully encloses housing 32 except for openings aligned with ports 33 and the bottom or lower surface of the housing and includes a front shield component 52 and a rear shield component 53. Additional shielding components 54 are positioned adjacent and generally surround ports 33 to complete shield assembly 50. The joinable front and rear shield components are formed with interlocking tabs 55 and openings 56 for engaging and securing the components together when the shield assembly 50 is placed into position around the magnetic jack housing 32. Each of the shield components 52, 53 includes ground pegs 57, 58, respectively, that extend into ground through-holes 102 in the circuit board 100 when mounted thereon. The shield assembly, as depicted, is formed of multiple, conductive components formed of sheet metal material.

Figure 4:
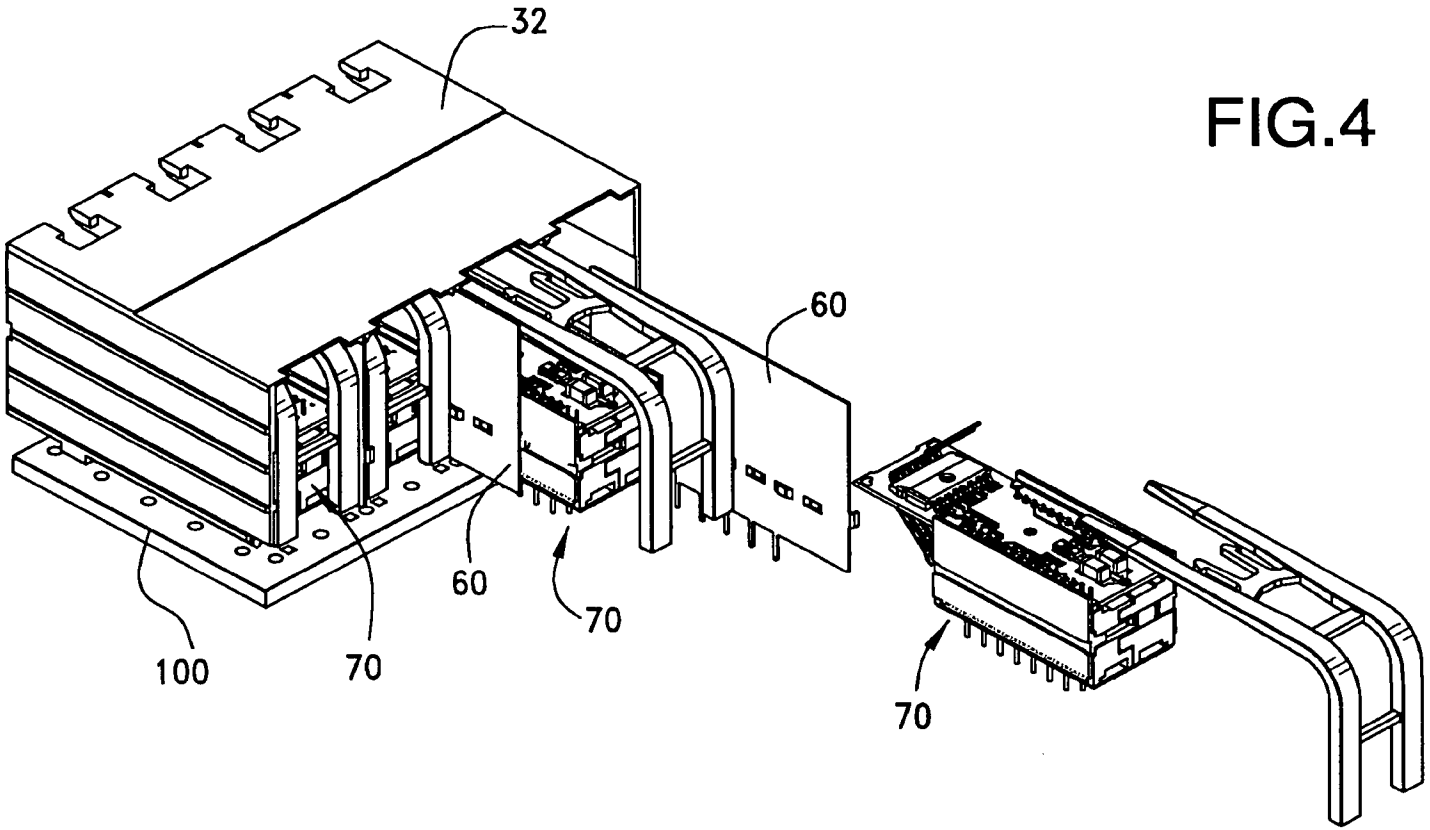
FIG. 4 is a partially exploded rear perspective view of the magnetic jack assembly of FIG. 1 with the internal subassembly modules and inter-module shields in various stages of insertion within the housing and with the outer shielding removed for clarity.
Figure 5:
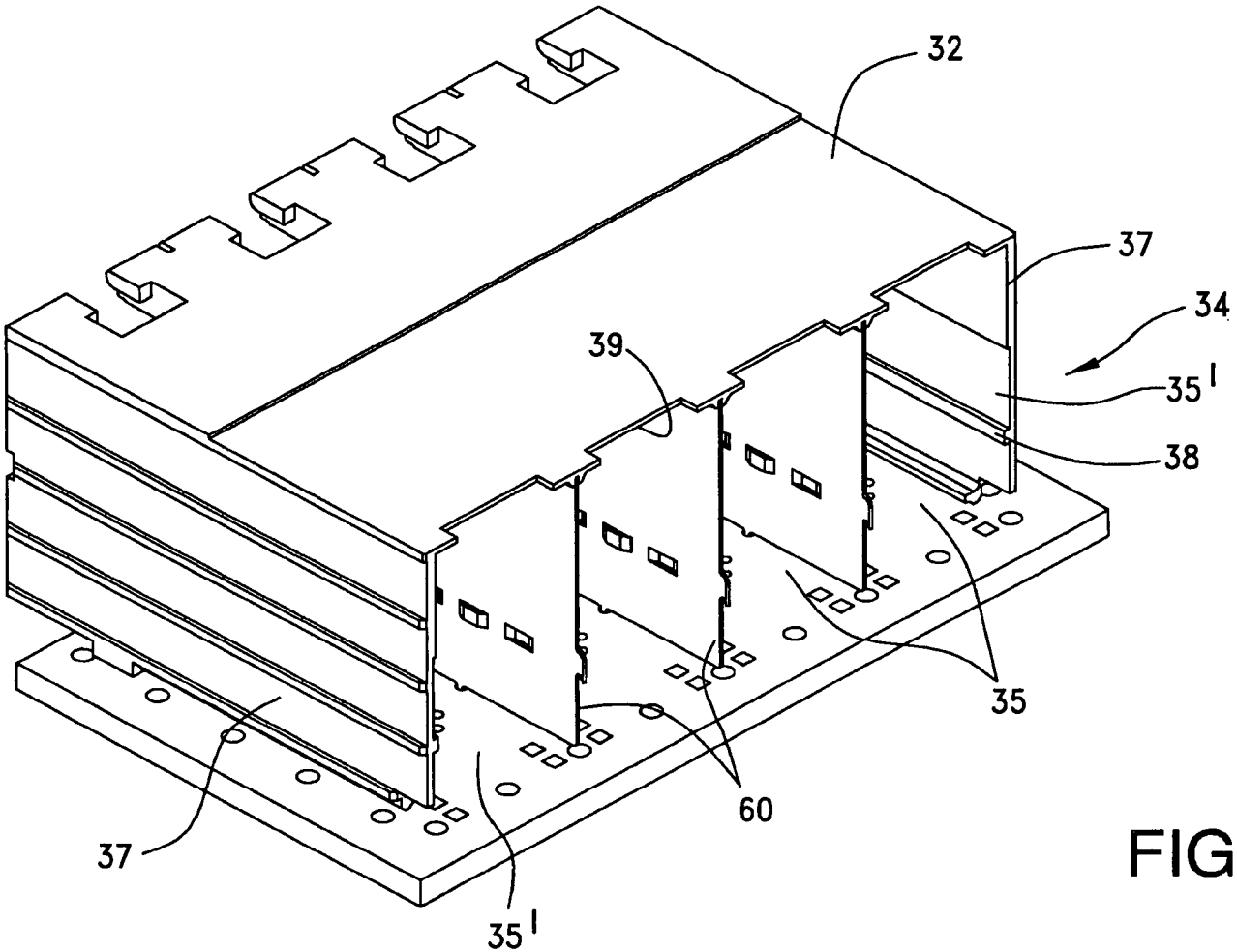
FIG. 5 is a rear perspective view similar to FIG. 4 but with each of the internal modules removed and the inter-module shields fully inserted.
Figure 6:
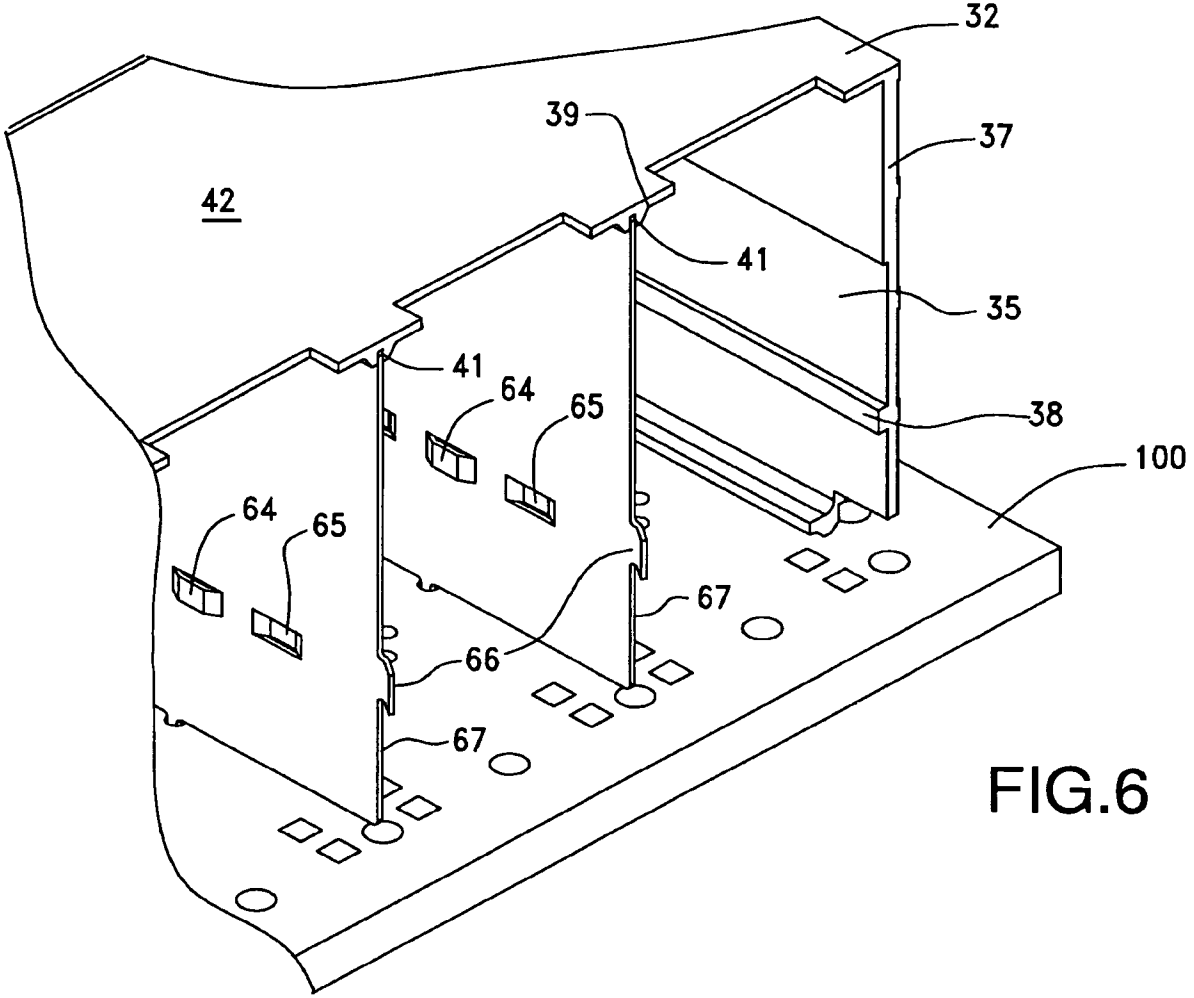
FIG. 6 is an enlarged fragmented perspective view of a portion of FIG. 5.

As depicted in FIGS. 4-6, the rear portion of the magnetic jack housing 32 includes a large opening or receptacle 34 with three evenly spaced metal inter-module shields 60 positioned therein to define four subassembly receiving cavities 35. Each cavity 35 is sized and shaped to receive an internal subassembly module 70. While three inter-module shields 60 are depicted, a different number of shields may be used to define a different number of cavities. More specifically, to provide vertical electrical isolation or shielding between each module 70, one shield fewer in number than the desired number of modules is utilized. Shield 60 as depicted is stamped and formed of sheet metal material but could be formed of other conductive materials such as die cast metal or plated plastic material.

Figure 8:
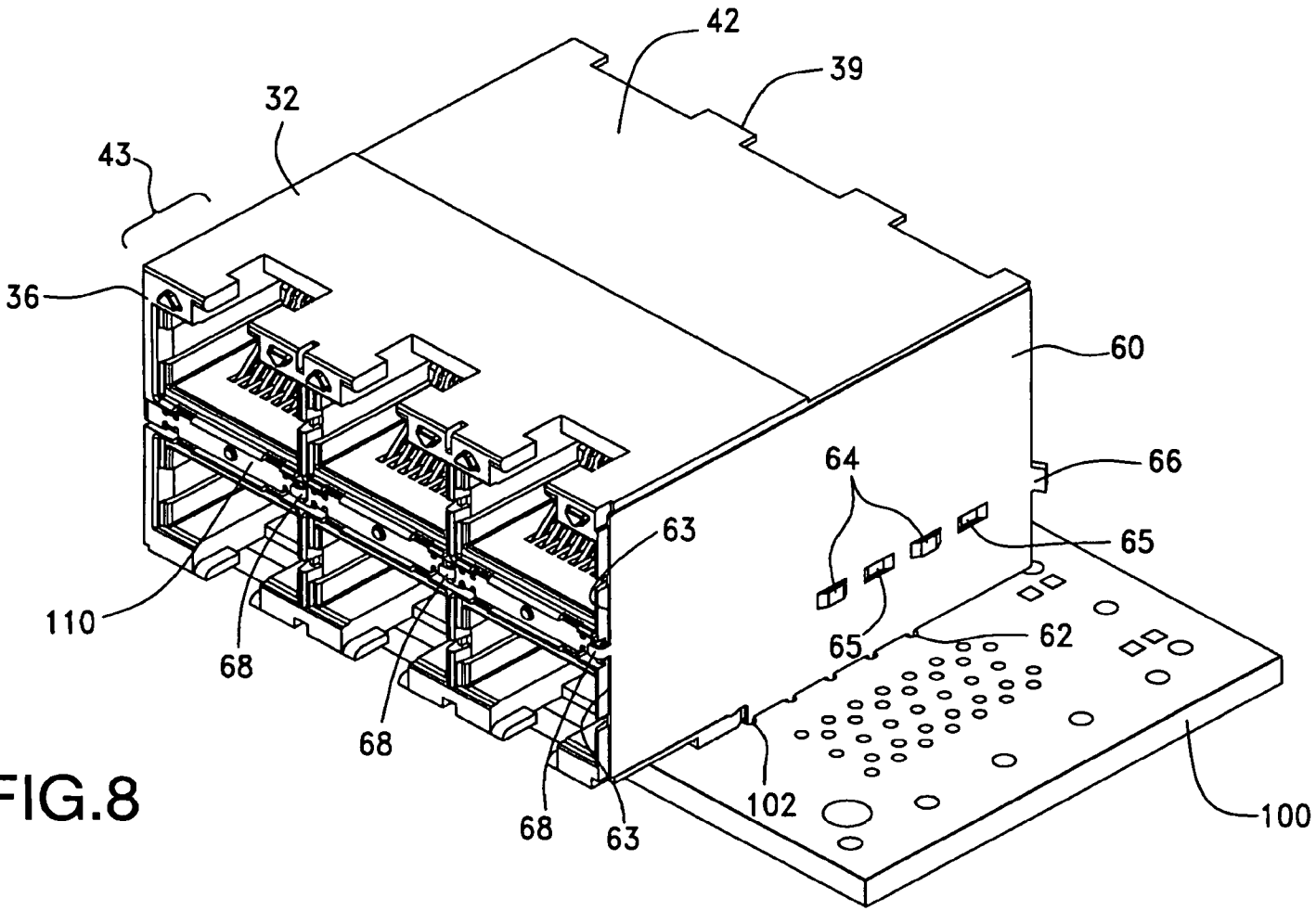
FIG. 8 is a cross-sectional view of the housing assembly taken generally along line 8-8 of FIG. 7.

As best seen in FIG. 8, each inter-module shield 60 is a generally rectangular, planar member and includes a plurality of spaced apart solder tails 62 for insertion into ground through-holes 102 in circuit board 100. The leading or front edge 63 of inter-module shield 60 extends to a location generally adjacent the front face 36 of housing 32. Inter-module shield 60 extends the full depth of magnetic jack 30 in the mating direction "A" of the Ethernet plugs (not shown) that are inserted into ports 33.

Each inter-module shield 60 includes two pairs of guide projections 64, 65 that extend in opposite directions into cavities 35 in order to guide and provide support to modules 70. More specifically, each inter-module shield 60 includes a first pair of guide tabs 64 that are sheared, drawn and formed out of the shield and extend in a first direction (to the left as seen in FIG. 6) and a second pair of guide projections 65 formed in a similar manner and extending in an opposite direction (to the right as viewed in FIG. 6). Together, the guide projections 64, 65 of each pair of inter-module shields 60 define guide rails that are dimensioned to engage a channel 72 in cover 95 on each side of module 70. Each cavity 35 defined by a pair of inter-module shields 60 includes guide rails defined by projections 64 on one side of the cavity and projections 65 on the other side of the cavity. The two outer cavities 35' that are defined by the side walls 37 of housing 32 and one of the module shields 60 have a first guide rail defined by the guide projection of the module shield and a second guide rail defined by projection 38 extending along the inside of side wall 37 of housing 32. As a result, the modules 70 are supported on both sides within housing 32 regardless of whether the sides of the cavities 35 are defined by a pair of inter-module shields 60 or a single inter-module shield 60 and a side wall 37 of housing 32.

Figure 9:
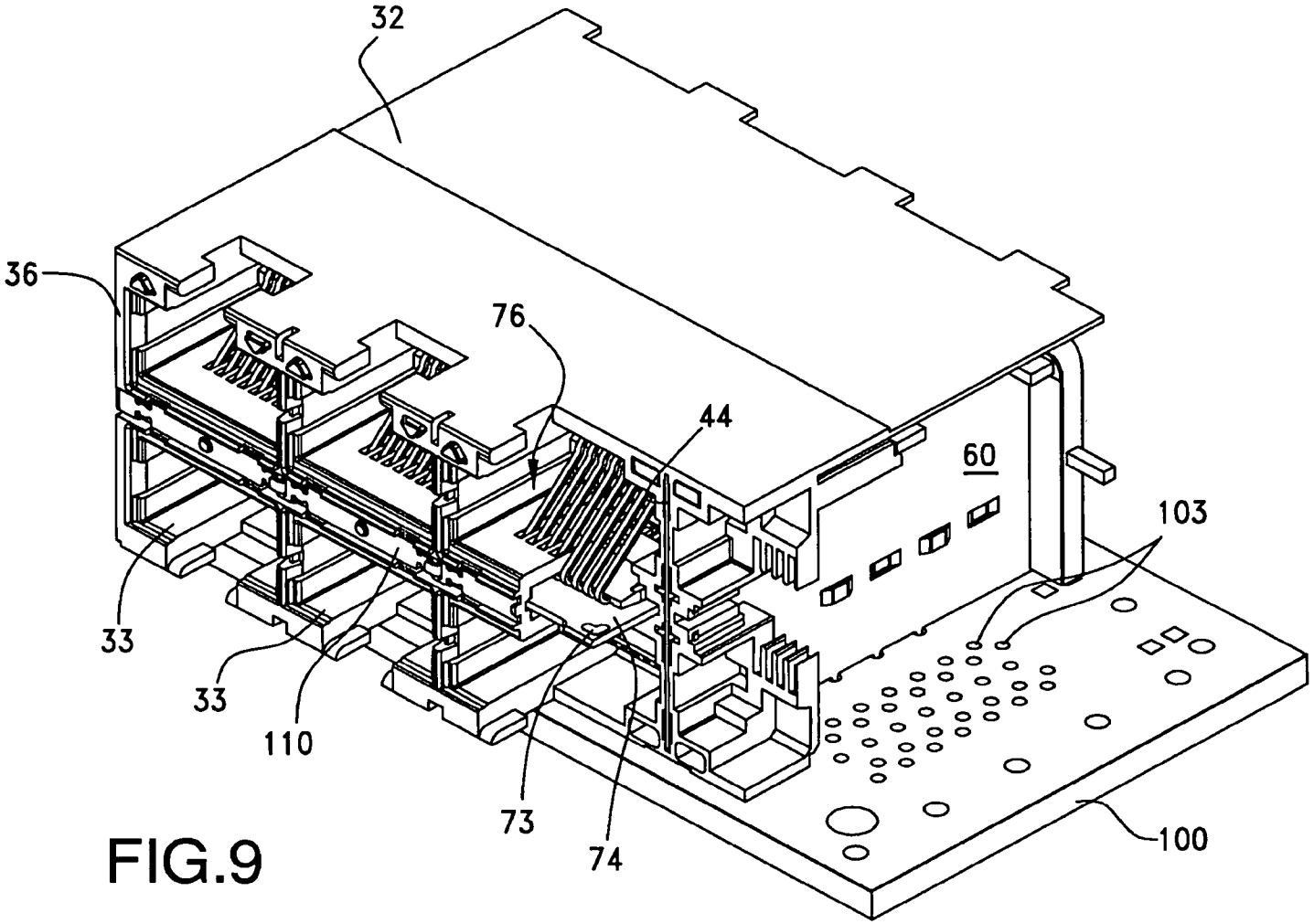
FIG. 9 is a cross-sectional view taken generally along line 9-9 of FIG. 7 but with the circuit board and connector of one of the internal subassembly modules un-sectioned for clarity.
Figure 10:
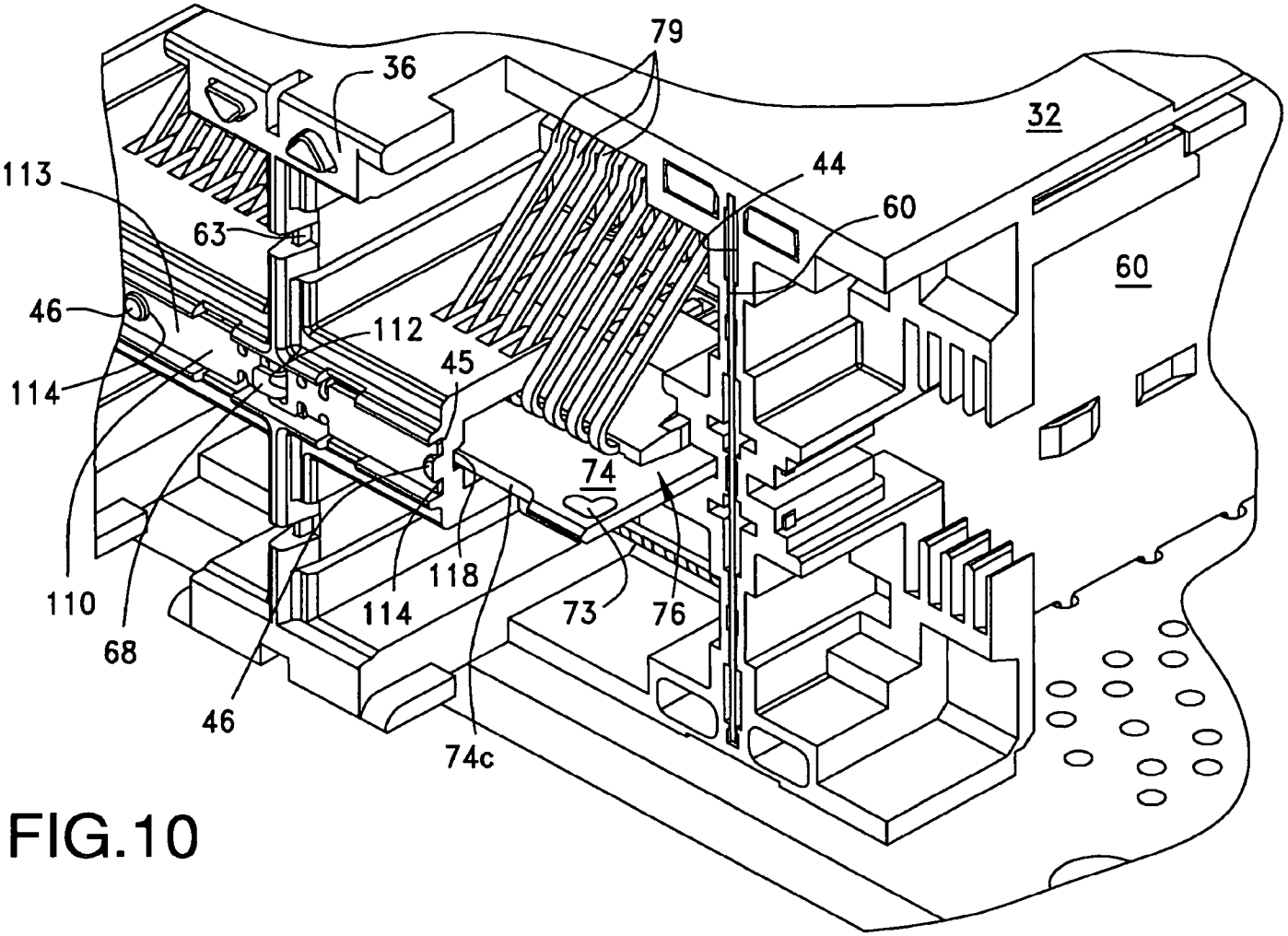
FIG. 10 is an enlarged fragmented perspective view of a portion of FIG. 9.
Figure 11:
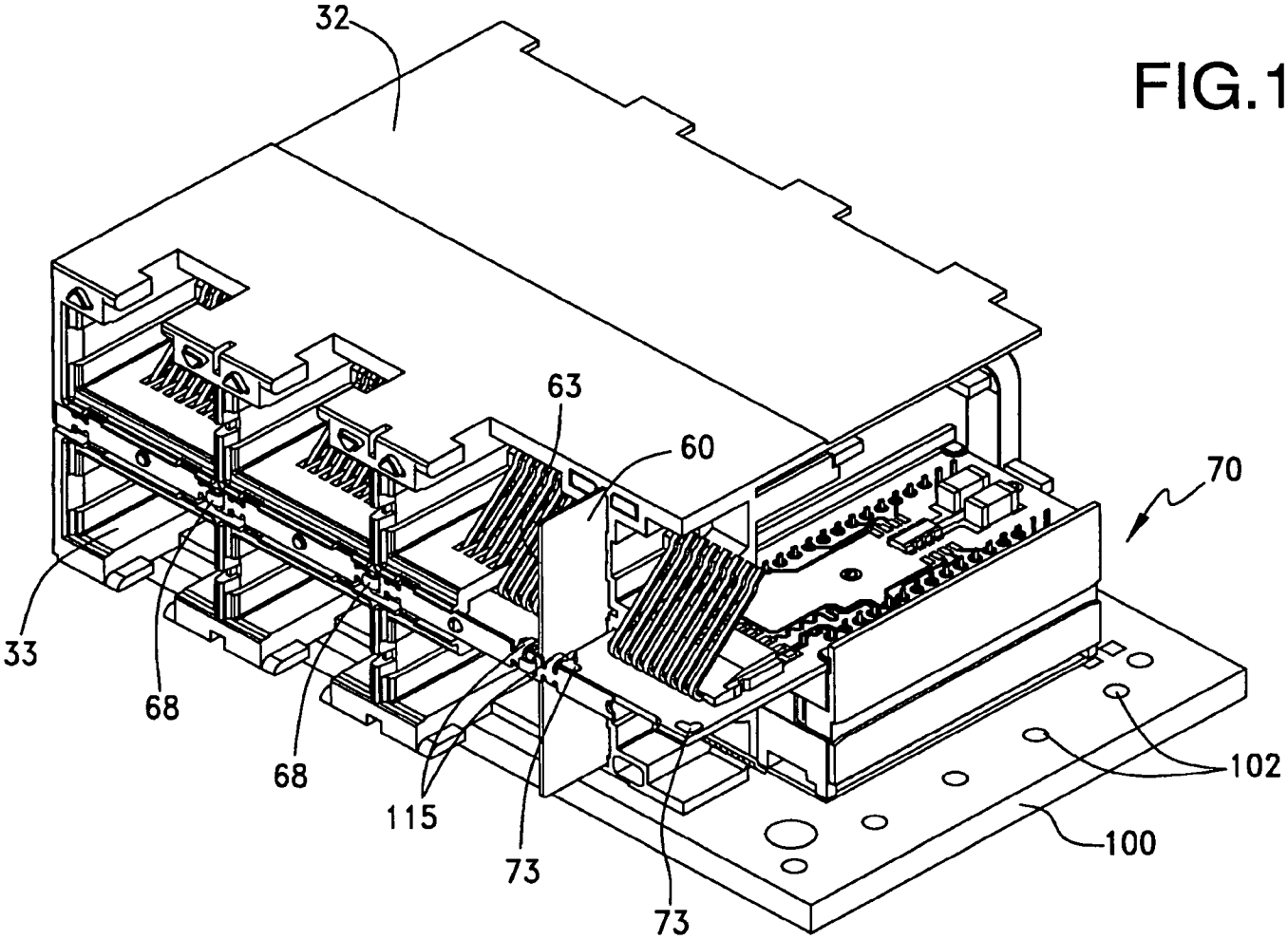
FIG. 11 is a cross-sectional view similar to FIG. 9 but with an inter-module shield un-sectioned, an additional internal subassembly module inserted into the housing and the shield interconnection clip partially extended for clarity.

As depicted, inter-module shields 60 are inserted from the rear face or surface 39 of housing 32 and are received in slots or channels 41 (FIG. 6) that extend along the inner surface of top wall 42 of housing 32 in a direction generally parallel to the insertion direction "A" of the Ethernet or RJ-45 type plugs. The front portion 43 of housing 32 at which the ports 33 are located includes vertical slots 44 (FIGS. 9-10) into which the leading edge 63 of inter-module shield 60 is inserted in order to permit the leading edge 63 of module shield 60 to extend almost to the front face 36 of housing 32 in order to provide vertical shielding between adjacent vertical pairs of ports 33'. In other words, vertical shielding is provided by inter-module shields 60 from adjacent the rear face 39 of housing 32 to adjacent the front face 36 of housing 32 to separate and shield adjacent modules 70 together with their respective ports.

Figure 3:
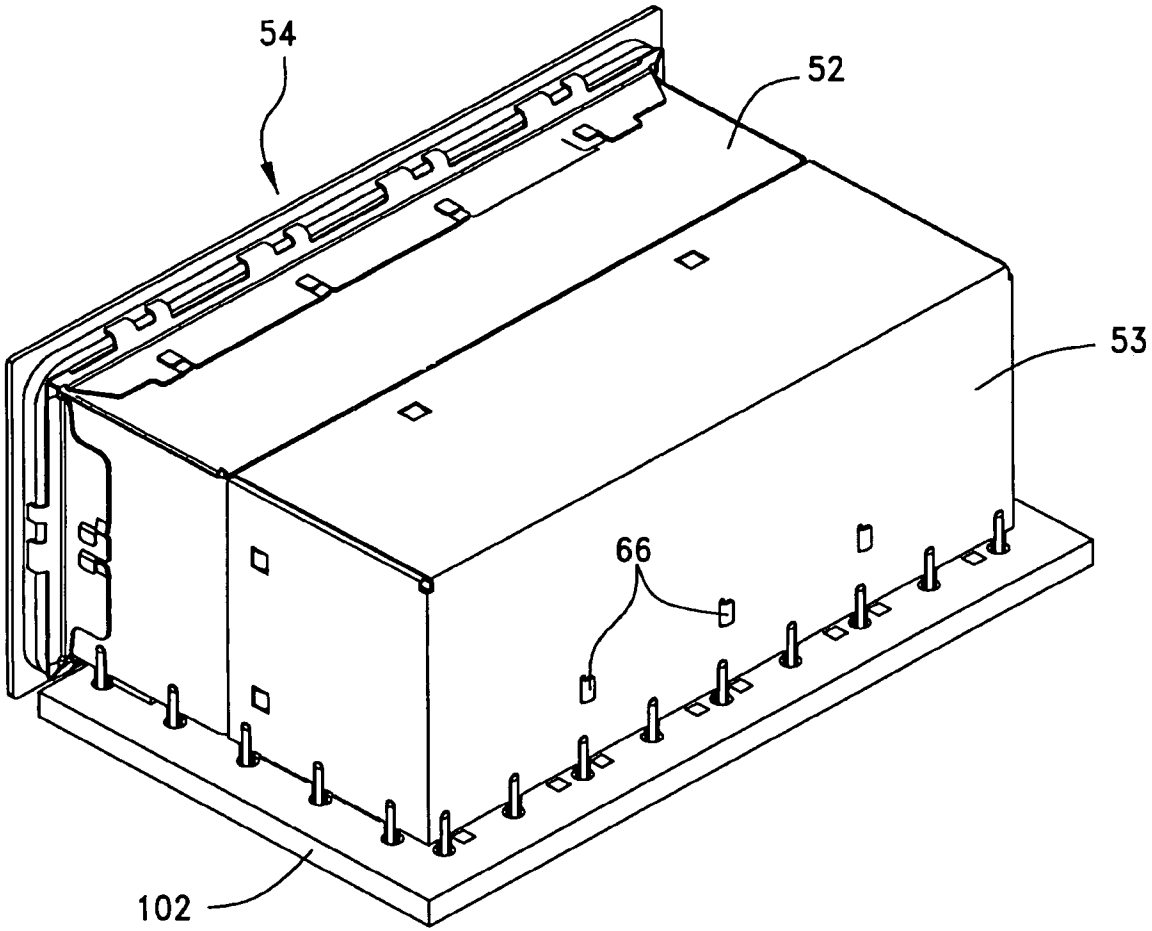
FIG. 3 is a rear perspective view of the magnetic jack assembly of FIG. 1.

Rear tab 66 extends from the rear edge 67 of each inter-module shield 60 and through slot 57 in rear shield component 53 and then is folded over as best seen in (FIGS. 3, 6) in order to mechanically and electrically connect inter-module shield 60 to rear shield component 53. (Some of tabs 66 are depicted in the drawings as already having been folded over even though the folding process occurs after the rear shield member 53 has been mounted to housing 32.) Front tab 68 (FIGS. 8,10) extends from the front edge 63 of each module shield 60 and through slot 112 of shield interconnection or tying clip or strap 110 and then is folded over in order to mechanically and electrically connect inter-module shield 60 to clip 110.

Clip 110 is a generally elongated, conductive member that extends along the front face 36 of housing 32 between the upper and lower ports 33 and is configured to mechanically and electrically interconnect various shielding components generally adjacent the front portion of jack 30. More specifically, clip 110 has an elongated section 113 with a plurality of slots 112 corresponding in number to the number of inter-module shields 60 of jack 30 and a plurality of alignment holes 114 located between slots 112 and corresponding in number to the number of vertically aligned pairs of ports 33. Elongated section 113 is dimensioned to be positioned within a recessed area 45 in the front face 36 of housing 32 with alignment projections 46 extending from the recessed area 45 into alignment holes 114 in order to properly position the clip 110 relative to housing 32.

A pair of vertically aligned, deflectable contact arms 115 are located on opposite sides of each slot 112. Each contact arm is dimensioned and configured to engage one of the conductive ground contact pads 73 located on the top and bottom surfaces of circuit board 74 of internal subassembly module 70 adjacent the leading or forward edge 74*c* of board 74. Elongated section 113 is substantially taller or wider than the thickness of upper circuit board 74. In other words, the vertical dimension of section 113 is greater than the thickness of board 74. Since contact arms 115 are connected to ground pads 73 that are connected to the ground planes within board 74, the elongated section 113 of clip 110 provides additional shielding to the forward end of 74*c* of board 74 to further increase the electrical isolation between vertically aligned ports.

Figure 7:
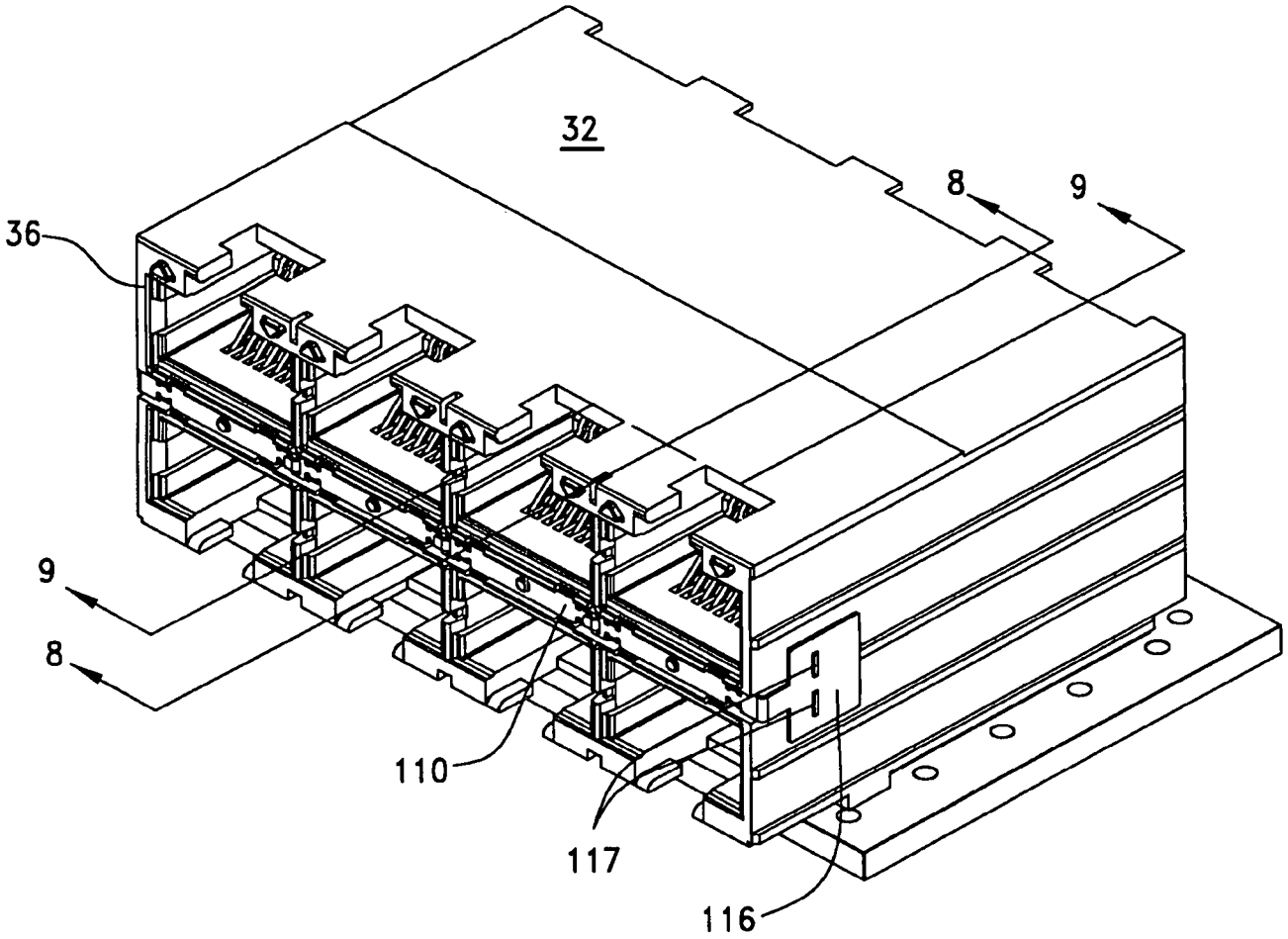
FIG. 7 is a front perspective view of the magnetic jack assembly of FIG. 1 with the outer housing removed for clarity.

An enlarged shield engagement section 116 (FIG. 7) extends around each side wall 37 of housing 32 for engaging front shield 52 once front shield 52 is mounted on the front portion of housing 32. Raised embossments 117 extend outward from engagement sections 116 to provide areas of increased contact pressure to provide a reliable electrical connection between clip 110 and front shield 52.

Each inter-module shield 60 is secured within magnetic jack 30 on three surfaces. The leading edge 63 is located within vertical slot 44 in housing 32 and tab 68 extends through slot 112 of shield interconnection clip 110. The upper surface of shield 60 is located within channel 41 in upper wall 42 of housing 32 and the rear edge 67 of shield 60 is secured by rear tab 66 that extends through slot 57 in rear shield component 53. Each inter-module shield 60 is thus electrically and mechanically connected to rear shield component 53 and is electrically connected to front shield component 52 and each circuit board 74 through clip 110.

Each inter-module shield 60 fully divides or splits receptacle 34 and extends from front face 36 of housing 32 to the rear edge 39 of housing 32 and from upper wall 42 to the lower mounting surface of housing 32. As a result, each module shield 60 provides vertical shielding between adjacent pairs 33' of upper and lower ports 33 and Ethernet or RJ-45 type plugs (not shown) that are inserted therein as well as the subassembly modules 70 inserted into subassembly receiving cavities 35.

Figure 12:
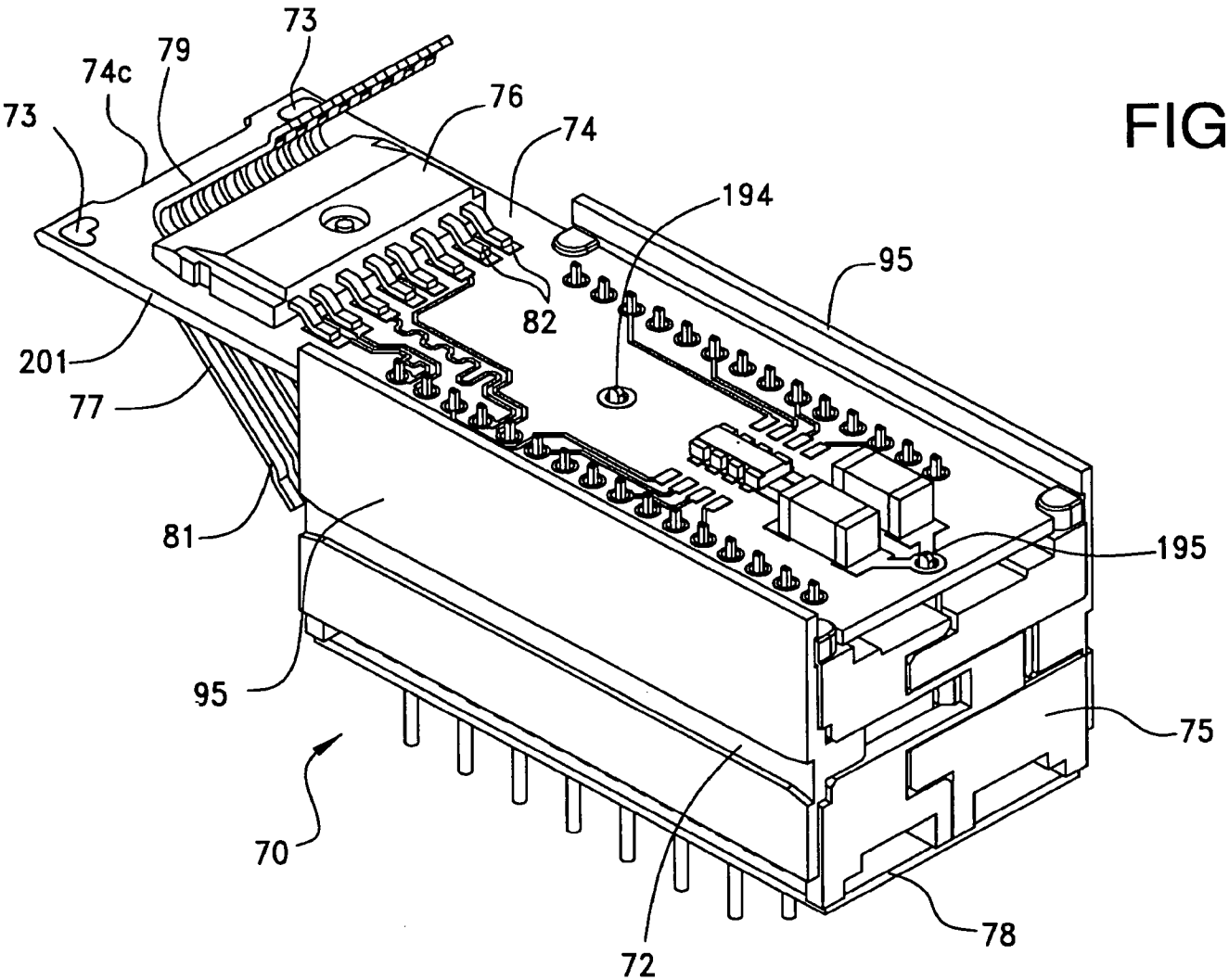
FIG. 12 is a rear perspective view of an internal subassembly module.
Figure 13:
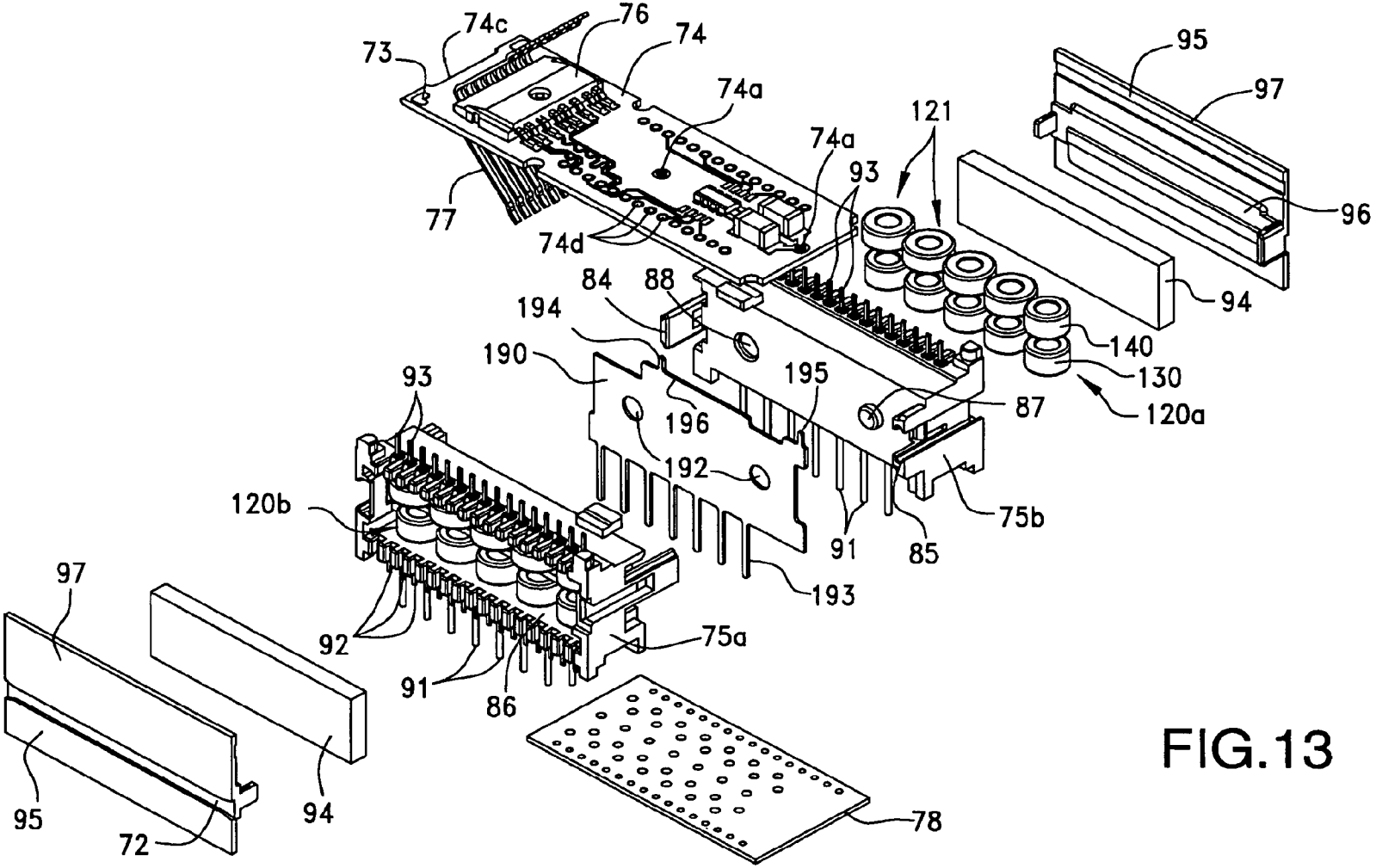
FIG. 13 an exploded perspective view of the internal module of FIG. 12 with the windings removed for clarity.

Referring to FIGS. 12-13, each internal subassembly or jack module 70 includes a component housing 75 with transformer circuitry and filtering components therein. An upper circuit board 74 is mounted generally adjacent an upper surface of component housing 75 and includes upper and lower contact assemblies 76, 77 mechanically and electrically connected thereto. Lower circuit board 78 is mounted generally adjacent a lower surface of component housing 75. The upper and lower circuit boards 74, 78 may include resistors, capacitors and other components associated with the transformers and chokes located inside the component housing 75. As can be from FIG. 16 (which depicts an embodiment of a circuit board 74), the reference circuitry/plane can extend substantially all the way to a front edge of the circuit board. This allows the reference layer to extend forward of the contacts 77, 79 that are supported by the circuit board 74. This is been determined to provide a substantial improvement in shielding between an upper port and a lower part.

Subassembly module 70 includes the upper contact assembly 76 and lower contact assembly 77 for providing a stacked jack, or dual jack, functionality. The upper contact assembly 76 is mounted to an upper surface of upper circuit board 74 and provides physical and electrical interfaces, including upwardly extending contact terminals 79, for connecting to an Ethernet plug inserted within port 33 in the upper row of ports. The lower contact assembly 77 is mounted to a lower surface of upper circuit board 74 and includes downwardly extending electrically conductive contact terminals 81 for connection to an Ethernet plug inserted within a port 33 in the lower row of ports. Upper contact assembly 76 is electrically connected to the upper circuit board 74 through leads, which are soldered, or electrically connected by some other means such as welding or conductive adhesive, to a row of circuit board contacts or pads 82 that are positioned along the top surface of upper circuit board 74 generally adjacent a forward edge of component housing 75. Lower contact assembly 77 is similarly mounted on a lower surface of upper circuit board 74 and is connected to a second, similar row of circuit board pads 83 on a lower surface of upper circuit board 74.

Component housing 75 is a two-piece assembly having a left housing half 75*a* and right housing half 75*b*; one for holding the magnetics 120*a* of the upper port and the other for holding the magnetics 120*b* of the lower port of each pair of vertically aligned ports. The left and right housings halves 75*a*, 75*b* are formed from a synthetic resin such as LCP or another similar material and may be physically identical for reducing manufacturing costs and simplifying assembly. A latch projection 84 extends from the left sidewall (as viewed in FIG. 13) of each housing half. A latch recess 85 is located in the right sidewall of each housing half and lockingly receives latch projection 84 therein.

Each housing half 75*a*, 75*b* is formed with a large box-like receptacle or opening 86 that receives the filtering magnetics 120 therein. The receptacles 86 of the two housing halves 75*a*, 75*b* face in opposite directions and have an internal elongated shield member 190 positioned between the housing halves to electrically isolate the two receptacles. The surface of each housing half facing the elongated shield member 190 includes a projection 87 and a similarly sized socket 88 positioned such that when the two housing halves 75*a*, 75*b* are assembled together, the projection of each housing half will be inserted into the socket of the other housing half. The elongated shield member 190 includes a pair of holes 192 aligned with the projections 87 and sockets 88 such that upon assembling the housing halves 75*a*, 75*b* and shield member 190, each projection 87 will extend through one of the holes 192 and into its socket 88 in order to secure shield member 190 in position relative to the housing halves.

A first set of electrically conductive pins or tails 91 extend out of the lower surface of the housing halves 75*a*, 75*b* and are inserted through holes 78*a* in the lower circuit board 78 and soldered thereto. Pins 91 are long enough to extend past lower circuit board 78 and are configured to be subsequently inserted into holes 103 (FIG. 9) in circuit board 100 and soldered thereto. A second, shorter set of pins 92 also extend out of the lower surface of the housing halves 75*a*, 75*b*. A third set of electrically conductive pins 93 extend out of the upper surface of housing halves 75*a*, 75*b* and are inserted into holes 74*d* in upper circuit board 74 and soldered thereto.

The magnetics 120 provide impedance matching, signal shaping and conditioning, high voltage isolation and common-mode noise reduction. This is particularly beneficial in Ethernet systems that utilize cables having unshielded twisted pair ("UTP") transmission lines, as these line are more prone to picking up noise than shielded transmission lines. The magnetics help to filter out the noise and provide good signal integrity and electrical isolation. The magnetics include four transformer and choke subassemblies 121 associated with each port 33. The choke is configured to present high impedance to common-mode noise but low impedance for differential-mode signals. A choke is provided for each transmit and receive channel and each choke can be wired directly to the RJ-45 connector.

Elongated shield member 190 is a generally rectangular plate and includes seven downwardly depending solder tails 193 configured for insertion and soldering in holes 78*a* in lower circuit board 78. Tails 193 are long enough to extend past lower circuit board 78 and are subsequently inserted into holes (not shown) in circuit board 100 and soldered thereto. Two upwardly extending solder tails 194, 195 extend from a top surface or edge 196 of shield member 190 and are configured for insertion and soldering in holes 74*a* in upper circuit board 74. Shield member 190 is configured to shield the transformers 130 and chokes 140 as well as other circuit components of each housing half from those of its adjacent housing half in order to shield the circuitry of the lower port from that of its vertically aligned upper port.

Figure 18:
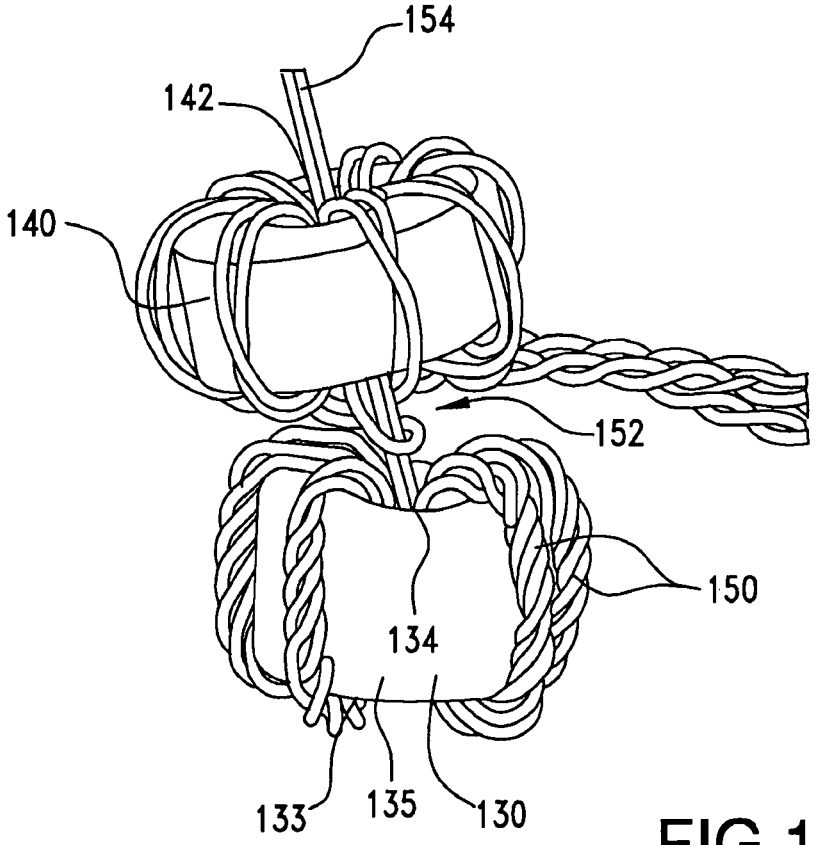
FIG. 18 is a side elevational view of a transformer and choke subassembly that may be used with the disclosed embodiment.

As described above, the magnetics 120 associated with each port 33 of the connector include four transformer and choke subassemblies 121. Referring to FIG. 18, one embodiment of a transformer and choke subassembly 121 can be seen to include a magnetic ferrite transformer core 130, a magnetic ferrite choke core 140, transformer windings 160 and choke windings 170. Transformer core 130 is toroidal or donut-shaped and may include substantially flat top and bottom surfaces 132, 133, a central bore or opening 134 that defines a smooth, cylindrical inner surface and a smooth, cylindrical outer surface 135. The toroid is symmetrical about a central axis through its central bore 134. Choke 140 may be similarly shaped.

Figure 17:
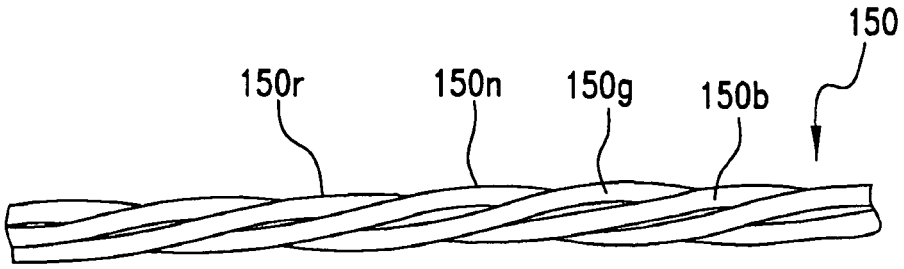
FIG. 17 is a side elevational view of twisted wires that may be used with the transformer and noise reduction components of the disclosed embodiment.

FIG. 17 illustrates a group of four wires 150 that are initially twisted together and wrapped around the transformer toroid 130. Each of the four wires is covered with a thin, color-coded insulator to aid the assembly process. As depicted herein, the four wires 150 are twisted together in a repeating pattern of a red wire 150*r*, a natural or copper-colored wire 150*n*, a green wire 150*g*, and a blue wire 150*b*. The number of twists per unit length, the diameter of the individual wires, the thickness of the insulation as well as the size and magnetic qualities of the toroids 130 and 140, the number of times the wires are wrapped around the toroids and the dielectric constant of the material surrounding the magnetics are all design factors utilized in order to establish the desired electrical performance of the system magnetics.

As shown in FIG. 18, the four twisted wires 150 are inserted into central bore or opening 134 of toroid 130 and are wrapped around the outer surface 135 of the toroid. The twisted wires 150 are re-threaded through central bore 134 and this process is repeated until the twisted wire group 150 has been threaded through the central bore a predetermined number of times. The ends of the twisted wires adjacent the lower surface 133 of the toroid 130 are bent upward along the outer surface 135 of toroid 130 and wrapped around the other end of the twisted wires to create a single twist 152 that includes all of the wires of the second end wrapped around all of the wires of the first end. The individual wires from the first and second ends are untwisted immediately beyond (or above as viewed in FIG. 18) the single twist 152. One wire from a first end of the group of twisted wires is twisted with a wire from the other end of the group of wires to create twisted wire sections 153. A choke twisted wire section 154 is slid into central opening 142 of choke toroid 140 and looped around the choke toroid the desired number of times.

As depicted, four transformer and choke assemblies 121 are inserted into each receptacle 86 and the wires are then soldered or otherwise connected to pins 92, 93. A shock absorbing, insulative foam insert 94 is then inserted into each receptacle 86 over the transformer and choke assemblies 121 to secure them in place. An insulative cover or member 95 is secured to each housing half 75*a*, 75*b* to enclose receptacle 86 and secure foam insert 94 therein and to provide shielding to pins 93.

Figure 14:
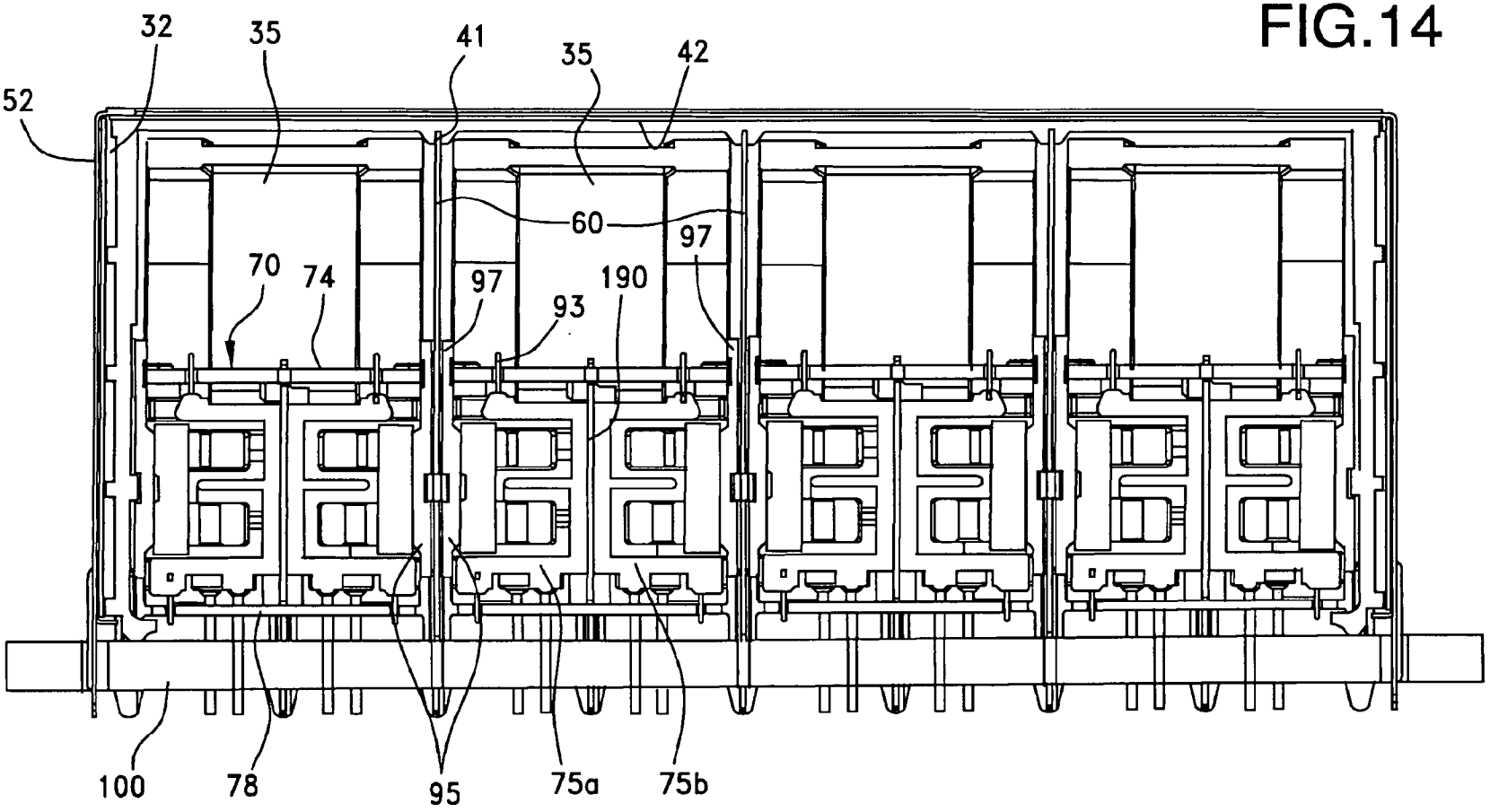
FIG. 14 is a cross-sectional view of the magnetic jack assembly taken generally along line 14-14 of FIG. 1.
Figure 15:
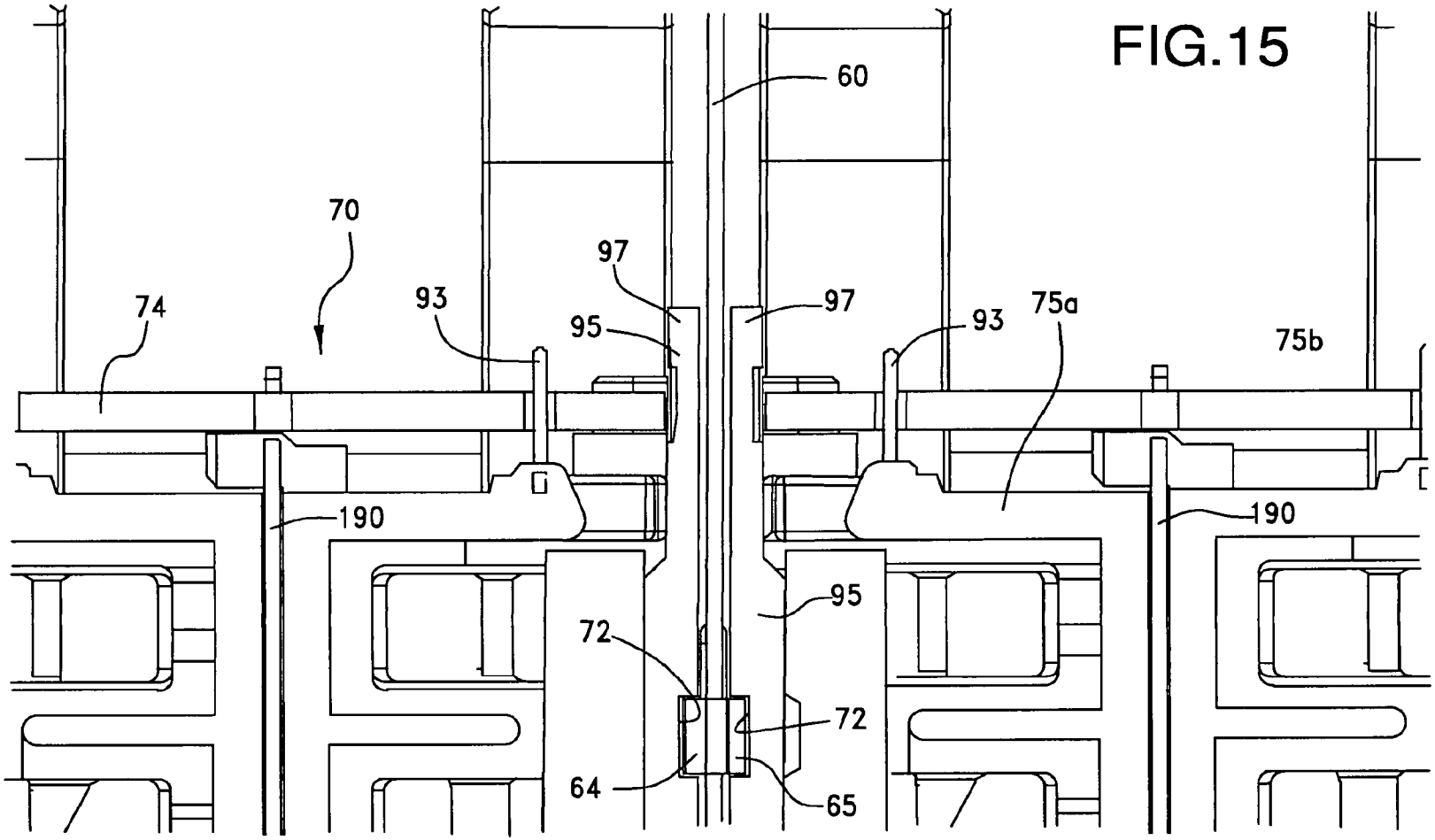
FIG. 15 is an enlarged fragmented view of a portion of FIG. 14.

Referring to FIGS. 13-15, each cover 95 includes sidewalls 96 that have a sidewall for enclosing receptacle 86 and an upwardly extending isolation wall 97 that extends above upper circuit board 74 and the electrically conductive pins 93 that project above the circuit board. Covers 95 may be formed from a synthetic resin such as LCP or another similar material. Due to the insulative properties of covers 95, isolation walls 97 provide an insulative barrier between pins 93 (as well as any exposed circuit traces of upper circuit board 74) and the vertical inter-module shields 60 that are positioned on opposite sides of each module. By interposing isolation walls 97 between inter-module shields 60 and pins 93 (and upper circuit board 74), the modular jack has increased electrical isolation between exposed signal conductors and ground or reference conductors. In an alternate embodiment, it may be possible to replace cover 95 with an insulating film or sheet, such as a polyimide film know as Kapton, applied to the side of each housing half 75*a*, 75*b* or applied directly to inter-module shields 60.

Figure 16:
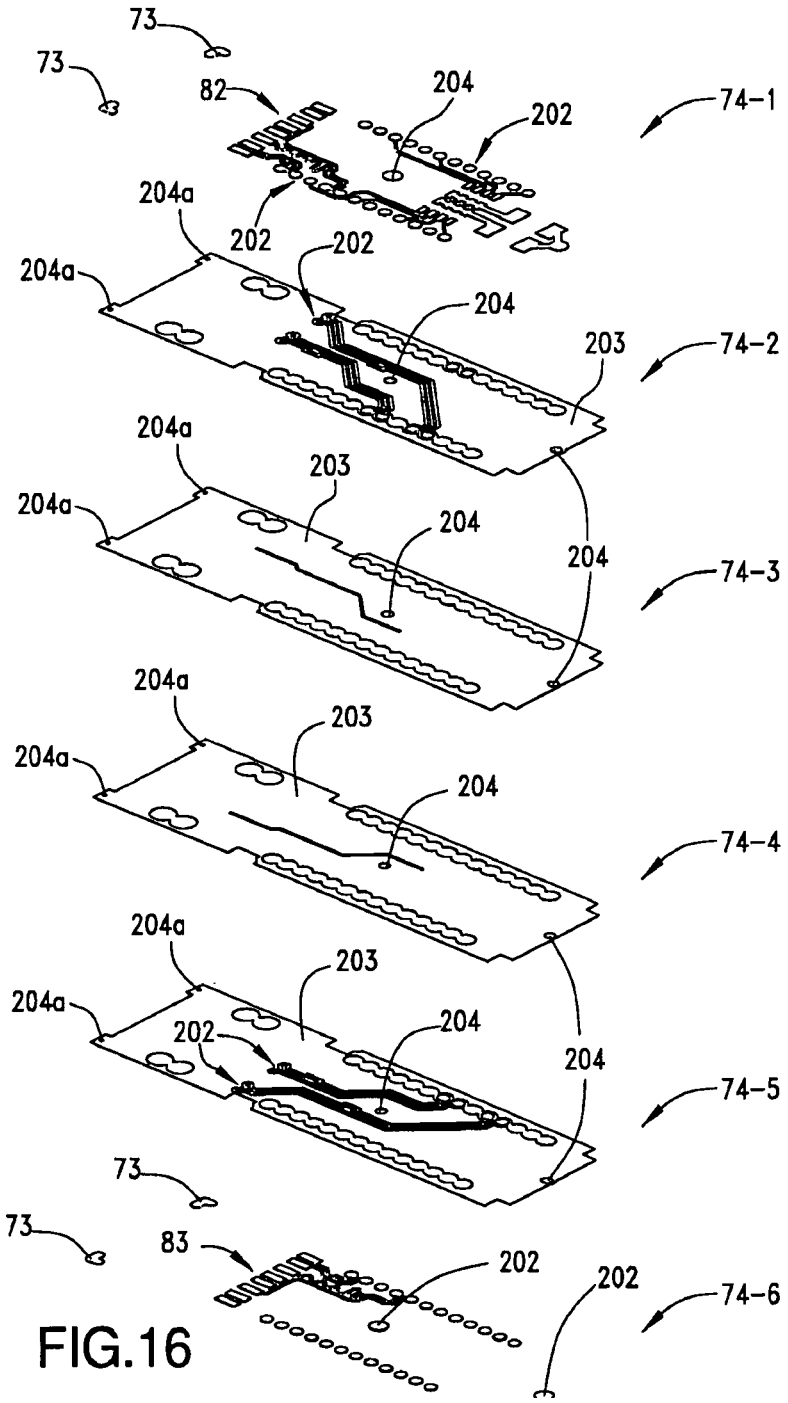
FIG. 16 is an exploded perspective view of the various conductive layers contained within the upper printed circuit board of the internal subassembly module of FIG. 12.

Referring to FIG. 16, upper circuit board 74 includes six conductive layers 74-1, 74-2, 74-3, 74-4, 74-5, 74-6. Each of the conductive layers is separated from an adjacent conductive layer by a layer of a dielectric or insulative material such that the circuit board is generally formed of a dielectric material 201 (FIG. 12) with the conductive layers in or on the dielectric material. Conductive layers 74-1 and 74-6 include signal conductors 202, conductive layers 74-3 and 74-4 include reference or ground conductors 203 and conductive layers 74-2 and 74-5 are a mixed layer with both signal conductors 202 and reference conductors 203. Once assembled, the reference conductors 203 are inter-connected by plated through-holes or vias 204. A top layer 74-1 includes various signal circuits together with a plurality of circuit board pads 82 that are connected to leads of upper contact assembly 76 by soldering or some other means such as welding or conductive adhesive. Lower conductive layer 74-6 also includes conductive circuitry similar to that of the signal conductors of layer 74-1 and a row of circuit board pads 83 to which lower contact assembly 77 is soldered or electrically connected by some other means such as welding or conductive adhesive.

Upper and lower conductive layers 74-1 and 74-6 include L-shaped conductive ground pads 73 generally adjacent the forward end 74*c* of upper circuit board 74. Conductive ground pads 73 are inter-connected to the ground reference circuitry of conductive layers 74-2, 74-3, 74-4 and 74-5 by conductive vias 204*a*. The reference conductors of the inner layers 74-2, 74-3, 74-4, 74-5 essentially extend the entire width and length of circuit board 74 to shield the upper port and related circuitry from the lower port and its circuitry. The various conductive layers of circuit board 74 provide identical high speed functionality to upper contact assembly 76 and lower contact assembly 77 so that the high speed electrical performance of the upper and lower ports of modular jack 30 is identical.

Figure 19:
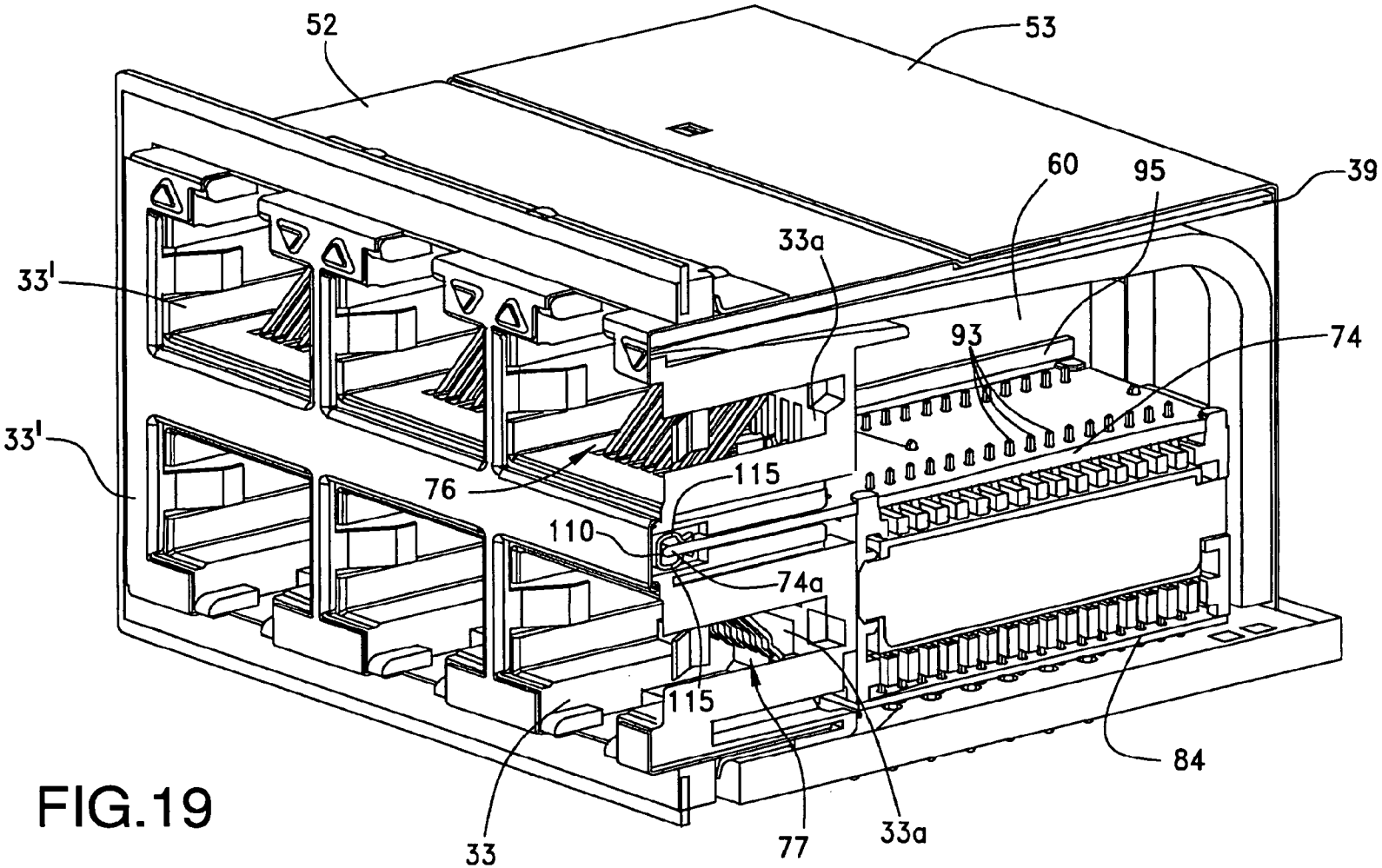
FIG. 19 is a cross-sectional view of the magnetic jack assembly taken generally along line 19-19 of FIG. 1.
Figure 20:
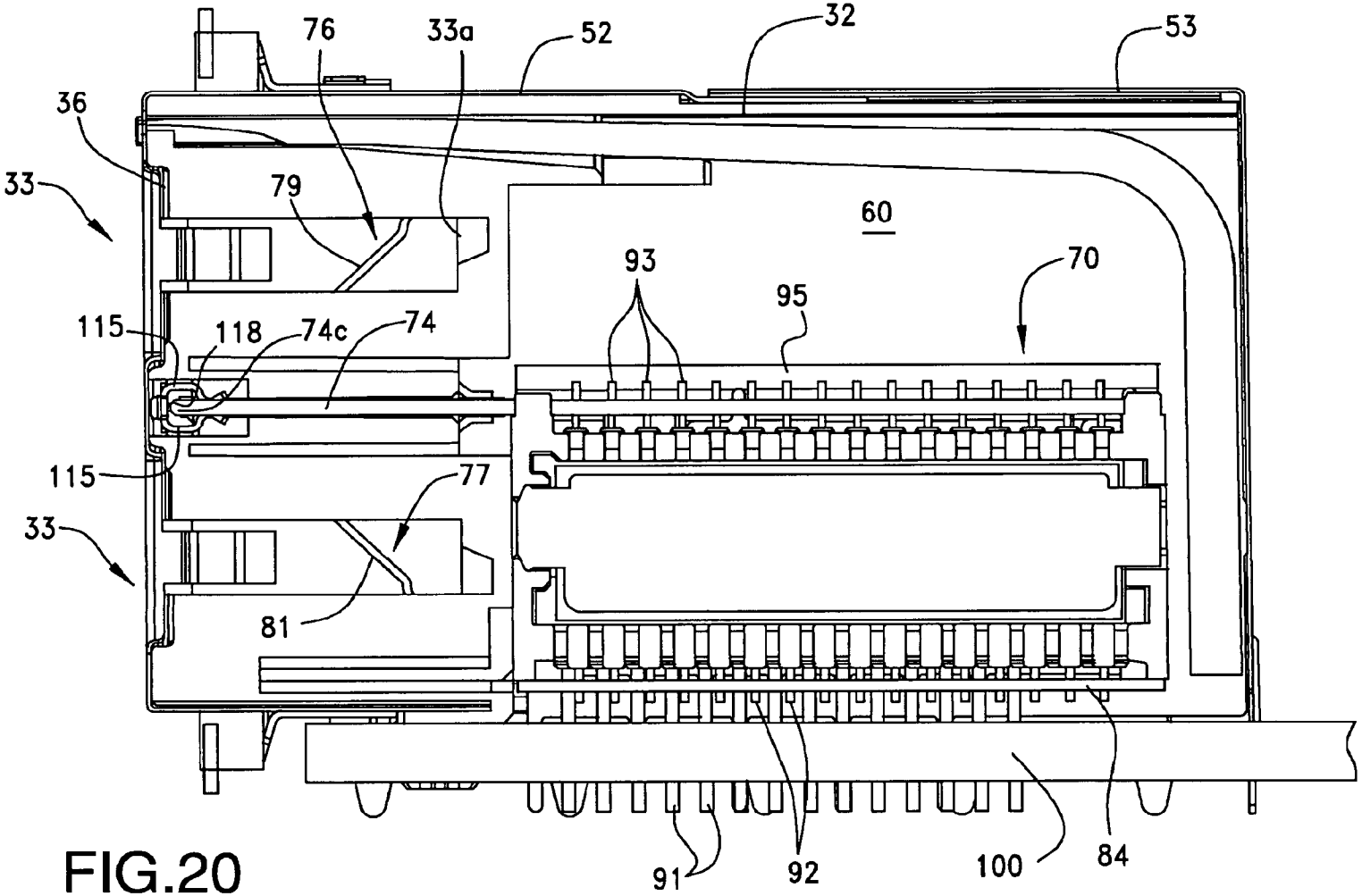
FIG. 20 is a side elevational view of the magnetic jack assembly of FIG. 19.
Figure 21:
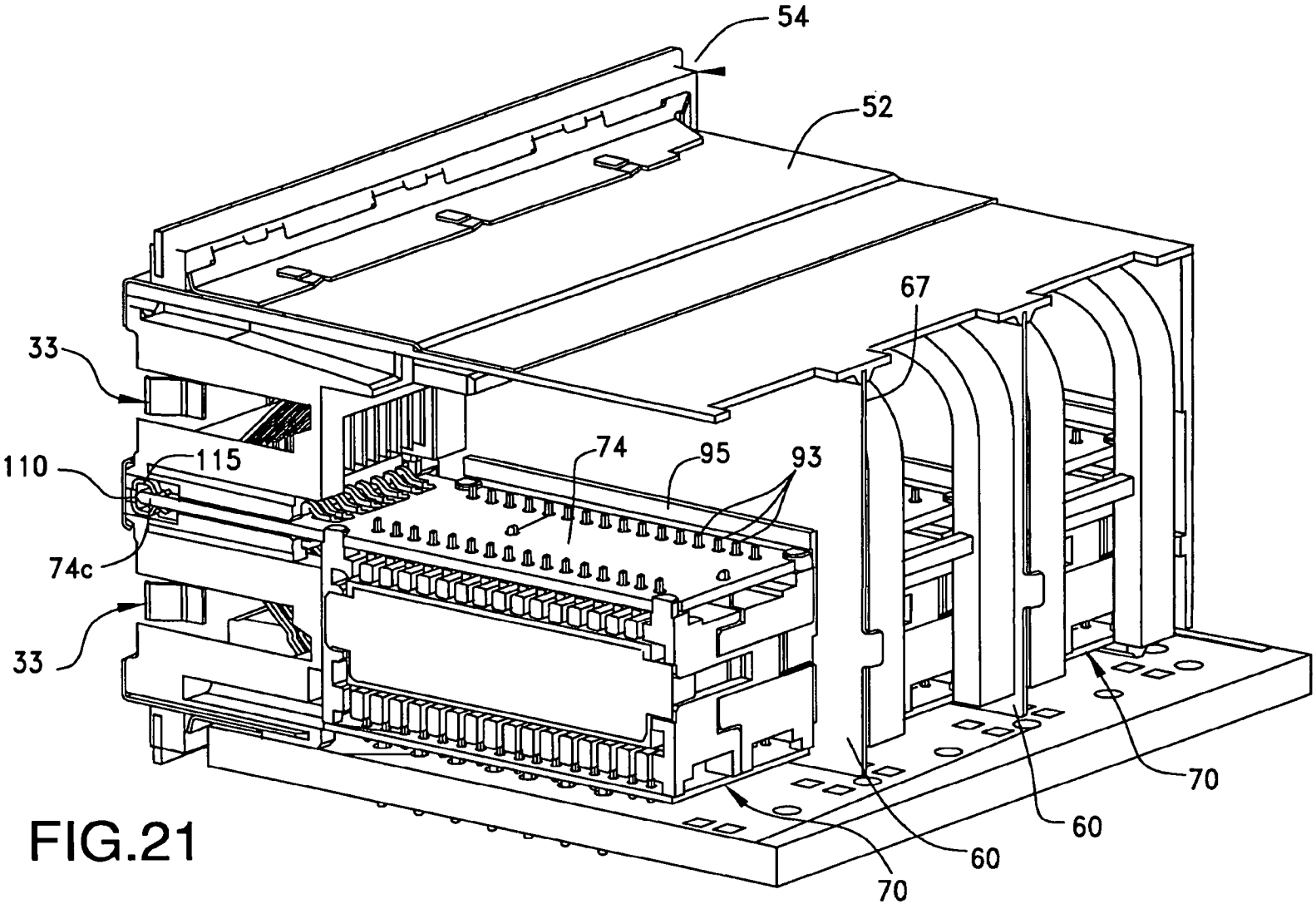
FIG. 21 is a rear perspective view of the magnetic jack assembly of FIG. 19 with the rear shield member removed for clarity.

Referring to FIGS. 19-21, it can be seen that internal subassembly modules 70 provide the electrical functionality to both the upper and lower ports 33 of a vertically aligned pair 33' of ports. Elongated shield member 190 within module 70 provides isolation and shielding between the transformers 130 and chokes 140 as well as other circuit components of each housing half from those of its adjacent housing half in order to shield the circuitry of the lower port from that of its vertically aligned upper port. Upper circuit board 74 extends from adjacent the rear edge 39 of housing 32 to the front face 36 of housing 32. Because upper circuit board 74 includes reference or ground members in the form of multiple conductive layers or planes along essentially its entire length and width, an electrical barrier is formed between the upper and lower ports of housing 32. In other words, electromagnetic interference and other types of noise and radiation will be reduced from passing between aligned upper and lower ports as a result of the electrical barrier formed by the reference planes within upper circuit board 74. In addition, conductive reference or ground contacts in the form of pads 73 located at the forward end 74*c* of circuit board 74 are connected to the reference planes and are engaged by deflectable contact arms 115 of clip 110 in order to electrically connect the reference layers within upper circuit board 74 and inter-module shields 60 and front shield component 52 through the use of shield inter-connection clip 110 as described above. As a result, the modular jack can be fully shielded along the top, opposite sides and rear and shielded along its front face except for the openings for each port 33.

Adjacent vertically aligned ports 33, jacks inserted therein and internal subassembly modules 70 inserted into subassembly receiving cavities 35 are shielded from adjacent ports, jacks, and modules 70 by inter-module shields 60. Shielding between vertically aligned ports is achieved by an internal shield assembly formed of elongated shield member 190 contained within each subassembly module 70 between the circuit components of the upper and lower ports and the reference planes within the upper circuit board 74 that extend horizontally to divide each module receiving cavity 35 and extend from the front face 36 of housing 32 to the rear edge 39.

Referring to FIGS. 10, 12, 19-20, it can be seen (as noted above) that the upper and lower contact assemblies 76, 77 are spaced rearwardly from the forward edge 74*c* of upper circuit board 74 and that ground contact pads 73 are positioned between each contact assembly 76, 77 and the forward edge 74*c* of the upper circuit board. The mating interface between the contact assemblies and their mating plug often is a location that emits significant amounts of EMI and other electrical noise. Through the use of the reference planes within upper circuit board 74 and extending the end 74*c* of the upper circuit board horizontally beyond the location of contact assemblies 76, 77, the upper and lower contact assemblies are effectively shielded from each other which increases the electrical isolation between the vertically aligned ports.

It is believed that in some circumstances, it may be possible for the forward edge 74*c* of upper circuit board 74 (or the reference plane within the circuit board) to only extend partway between each port 33 towards front face 36 of housing 32. For example, if the upper circuit board only extends halfway between a rear wall 33*a* of port 33 and front face 36 of housing 32, sufficient isolation may be provided so long as the reference plane sufficiently affects the electric fields associated with each of the upper and lower contact assemblies 76, 77. In other words, depending on the system and the signals being passed through the jack 30, it may be sufficient if the reference plane within upper board 74 extends between or at least partially between the upper and lower contact assemblies 76, 77 so as to block a substantial amount of EMI between vertically aligned ports without extending all of the way to front face 36 of housing 32.

During assembly, module shields 60 are inserted into housing 32 and slid forward (opposite the direction of arrow "A" in FIG. 1) so that the shields are received in channels 41 (FIG. 6) that extend along the inner surface of top wall 39 of housing 32 and into vertical slots 44 (FIGS. 8-10) of the front portion 43 of the housing in order to define a plurality of subassembly receiving cavities 35. A subassembly module 70 is then inserted into each cavity 35 as depicted in FIG. 4 with the channels 72 in the covers 95 on the sides of each module engaging the guide rails formed either by projections 64, 65 extending from module shields 60 or projection 38 of the side wall 37 of housing 32. Subassembly module 70 is moved forward until forward edge 74*c* of upper circuit board 74 slides into slot 118 in the housing 32 near the front face 36 thereof.

Figure 2:
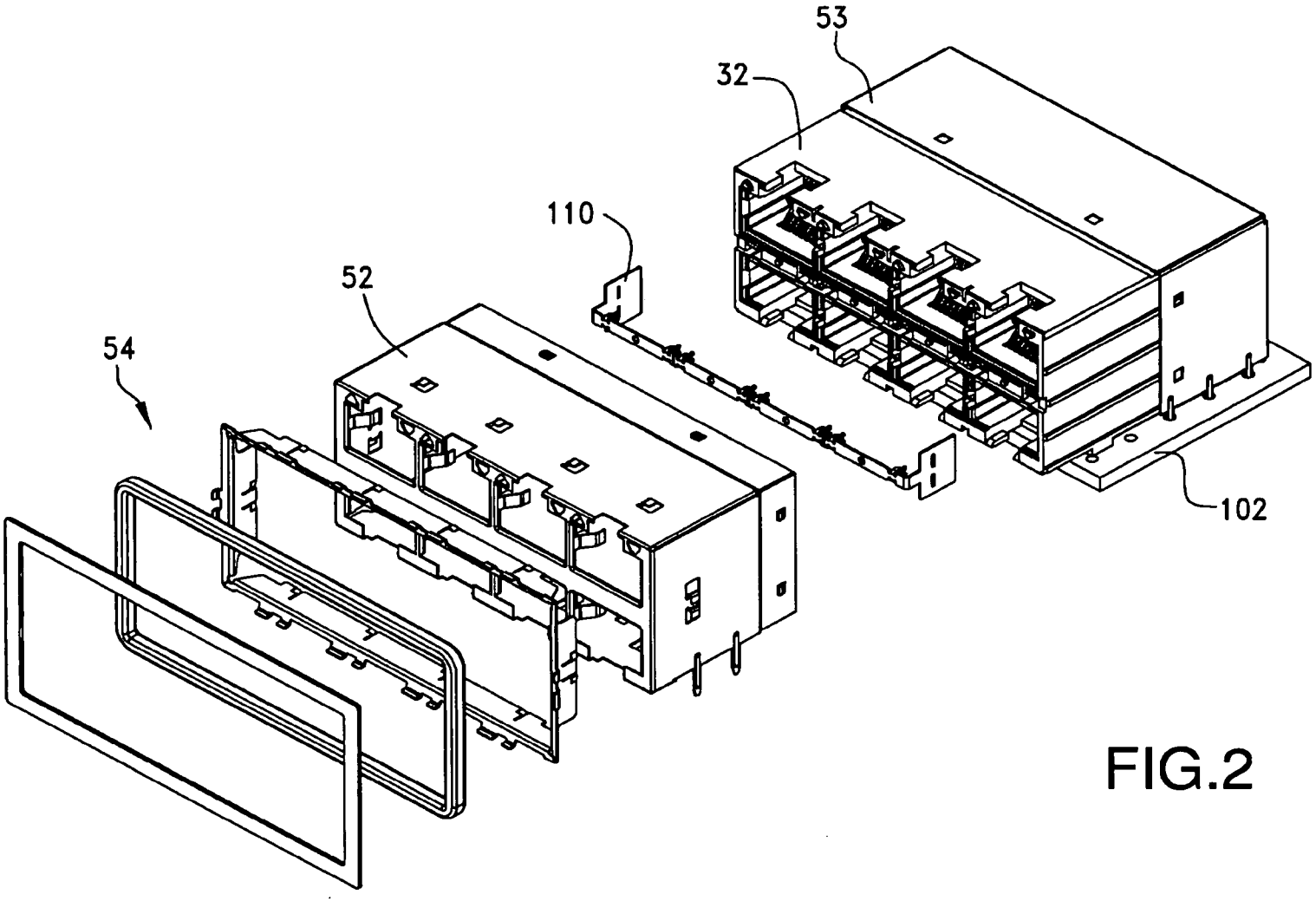
FIG. 2 a partially exploded view of the magnetic jack assembly of FIG. 1 with the front outer shielding and shield interconnection clip removed.

Clip 110 is then slid onto the front surface 36 of housing 32 with projections 46 of housing 32 extending into alignment holes 114 in the clip and with front tabs 68 from each module shield 60 extending into a slot 112 within the clip. Deflectable contact arms 115 slide onto the leading edge of upper circuit boards 74 and engage contact pads 73. Front tabs 68 are then bent over to secure tabs 68 to clip 110. Front shield component 52 is then slid onto housing 32 with the inner side surfaces of front shield component 52 engaging raised embossments 116 of enlarged shield engagement section 116 to complete the electrical connection between inter-module shields 60, upper circuit boards 74, clip 110 and front shield 52. Rear shield 53 is then slid and secured onto front shield 52. Rear tab 67 extends from the rear edge of each inter-module shield 60 and through slot 57 in rear shield component 53 and then is folded over as best seen in FIG. 2 in order to secure inter-module shield 60 to rear shield component 53.

With such structure, each inter-module shield 60 is secured within magnetic jack 30 at its leading edge 63 within vertical slot 44 in housing 32, along its upper edge by channel 41 in upper wall 42 of housing 32 and along its rear edge by rear tab 67 that engages rear shield component 53. Module shield 60 fully divides opening 34 and extends from front face 36 of housing 32 to the rear edge of 39 of housing 32 and from upper wall 42 to the lower mounting surface of housing 32. As a result, each module shield 60 provides vertical shielding between adjacent pairs of upper and lower ports 33 and Ethernet or RJ-45 type plugs that are inserted therein as well as the subassembly modules 70 inserted into subassembly receiving cavities 35. The reference planes within board 74 shield and the elongated shield member 190 shield the upper port from its vertically aligned lower ports.

Although the disclosure provided has been described in terms of illustrated embodiments, it is to be understood that the disclosure is not to be interpreted as limiting. Various alterations and modifications will no doubt become apparent to those skilled in the art after having read the above disclosure. For example, the modular jack is depicted as a right angle connector but may also have a vertical orientation. In addition, the housing as depicted is made of a dielectric material with separate shielding members mounted thereon. The housing could be made of a diecast or plated plastic material and the outer shield eliminated and the inter-module shields integrally formed with the housing. Accordingly, numerous other embodiments, modifications and variations within the scope and spirit of the appended claims will occur to persons of ordinary skill in the art from a review of this disclosure.

The invention claimed is:

1. A modular jack comprising:

a housing having a mating face and a plurality of openings therein configured as pairs of first and second aligned jack openings, each jack opening being configured to receive a mateable connector therein;

a clip supported by the housing and position on the mating face; and at least one subassembly module located in the housing and having a forward end and a rearward end, the subassembly module including a circuit member with a generally planar conductive reference plane extending between the forward and rearward ends, first and second sets of ground contact pads positioned on opposite sides of the circuit member, a forward portion of the reference plane being located between the pair of first and second aligned jack openings, wherein the clip is electrically connected to the circuit member.

2. The modular jack of claim 1, wherein the circuit member includes a plurality of signal traces.

3. The modular jack of claim 1, wherein the forward end of the circuit member and the forward portion of the reference plane extend generally to the mating face of the housing.

4. The modular jack of claim 3, wherein the forward end of the circuit member and the forward portion of the reference plane extend into a slot in the housing between the first and second aligned jack openings.

5. The modular jack of claim 1, further comprising a conductive shielding member, wherein the clip is electrically connected to the conductive shielding member.

6. The modular jack of claim 5, wherein the first and second sets of ground contact pads are positioned generally adjacent the mating face of the housing.

7. The modular jack of claim 6, wherein the conductive shielding member is a metal shield member generally surrounding the housing.

8. The modular jack of claim 7, wherein the conductive shielding member is a shield that substantially surrounds front, side, top and rear surfaces of the housing.

9. The modular jack of claim 6, wherein a contact arm connects at least one of the ground contact pads on each circuit member to the conductive shielding member.

10. The modular jack of claim 1, wherein the jack openings are vertically aligned.

11. A modular jack, comprising:

a housing having a mating face and a plurality of openings therein configured as pairs of first and second aligned jack openings, each jack opening being configured to receive a mateable connector therein; and at least one internal jack module located in the housing, the jack module including a circuit member with a generally planar conductive reference plane extending between forward and rearward ends thereof, first and second sets of electrically conductive contacts positioned on opposite sides of the circuit member, a forward portion of the reference plane being located between the pair of first and second aligned jack openings, a portion of each first electrically conductive contact extending into one of the first jack openings for engaging contacts of a mateable connector upon inserting a mateable connector into the first jack opening, and a portion of each second electrically conductive contact extending into the second jack opening aligned with a respective first jack opening for engaging contacts of a mateable connector upon inserting a mateable connector into the second jack opening, wherein each jack module includes first and second magnetics assemblies, each magnetics assembly including a transformer core having a plurality of wires wrapped therearound, some of the wires of the first magnetics assembly being electrically connected to some of the first electrically conductive contacts through first pins extending into the circuit member and some of the wires of the second magnetics assembly being electrically connected to some of the second electrically conductive contacts through second pins extending into the circuit member.

12. An electrical connector comprising:

a housing having a mating face and a pair of first and second aligned openings, each opening being configured to receive a mateable component therein, each opening having a front face and a rear wall;

a plurality of electrically conductive contacts, a portion of each contact being positioned in one of the openings for engaging contacts of a mateable component upon inserting a mateable component into one of the openings;

a conductive shielding member that extends along the front face; and a circuit member with a generally planar conductive reference plane extending between forward and rearward ends thereof, a forward portion of the reference plane being configured so as to extend at least half way between the rear wall and the front face, wherein the circuit member includes at least one ground contact pad that is electrically connected to the reference plane and the conductive shielding member.

13. The electrical connector of claim 12, wherein the circuit member includes a plurality of signal traces.

14. The electrical connector of claim 12, wherein the forward end of the circuit member and the forward portion of the reference plane extend generally to a mating face of the housing.

15. The electrical connector of claim 14, wherein the forward end of the circuit member and the forward portion of the reference plane extend into a slot in the housing between the first and second openings.

16. The electrical connector of claim 12, wherein the at least one ground contact pad is a generally planar contact pad positioned generally adjacent a mating face of the housing.

17. The electrical connector of claim 16, wherein the conductive shielding member is a metal shield member generally surrounding the housing.

18. The electrical connector of claim 17, wherein the conductive shielding member is a shield that substantially surrounds front, side top and rear surfaces of the housing.

19. The electrical connector of claim 17, wherein a contact arm is electrically connected to the conductive shielding member and connects the at least one ground contact pad to the conductive shielding member.

* * * * *